US006188373B1

(12) United States Patent
Martek

(10) Patent No.: US 6,188,373 B1
(45) Date of Patent: Feb. 13, 2001

(54) SYSTEM AND METHOD FOR PER BEAM ELEVATION SCANNING

(75) Inventor: Gary Allen Martek, Edgewood, WA (US)

(73) Assignee: Metawave Communications Corporation, Redmond, WA (US)

( * ) Notice: Under 35 U.S.C. 154(b), the term of this patent shall be extended for 0 days.

(21) Appl. No.: 09/034,471

(22) Filed: Mar. 4, 1998

Related U.S. Application Data

(63) Continuation-in-part of application No. 08/808,304, filed on Feb. 28, 1997, now Pat. No. 6,094,166, which is a continuation-in-part of application No. 08/680,992, filed on Jul. 16, 1996, now Pat. No. 5,940,048.

(51) Int. Cl.[7] ..... H01Q 21/00

(52) U.S. Cl. ..... 343/893; 343/853; 343/890; 342/375

(58) Field of Search ..... 343/853, 893, 343/846, 848, 890, 891; 342/371, 372, 373, 374, 375

(56) References Cited

U.S. PATENT DOCUMENTS 4,827,270 * 5/1989 Udugawa et al. ..... 343/853
5,264,862 * 11/1993 Kumpfbeck ..... 343/853
5,561,434 * 10/1996 Yamayaki ..... 343/700 MS
5,589,843 12/1996 Meredith et al. ..... 343/820
5,872,547 * 2/1999 Martek ..... 343/815
5,936,591 * 8/1999 Yamasa et al. ..... 343/853
5,940,048 * 8/1999 Martek ..... 343/893
5,969,689 * 10/1999 Martek et al. ..... 343/758
6,094,166 * 2/1999 Martek et al. ..... 342/374

* cited by examiner

*Primary Examiner*—Tan Ho
(74) *Attorney, Agent, or Firm*—Fulbright & Jaworski L.L.P.

(57) ABSTRACT

Systems and methods are disclosed for providing elevation scanning for a multiple beam antenna system on a per antenna beam basis. In a preferred embodiment columns of antenna elements are divided into sub-groups each having a beam forming matrix associated therewith. Phase differentials are introduced into the antenna beam signals of each sub-group of antenna elements in order to provide a phase progression which steers the antenna beam a predetermined angle from the broadside. The phase differentials are independently provided for each antenna beam signal to thereby allow independent steering of each antenna beam. Additionally, dielectric material placed in the signal feed path may be utilized to alter radiation characteristics of certain antenna elements of the antenna system. Placing the dielectric material with outer elements of an array may be used for aperture tapering and side lobe control. Additionally, wind loading, due to the antenna system is reduced by using a gridded ground plane system.

78 Claims, 14 Drawing Sheets

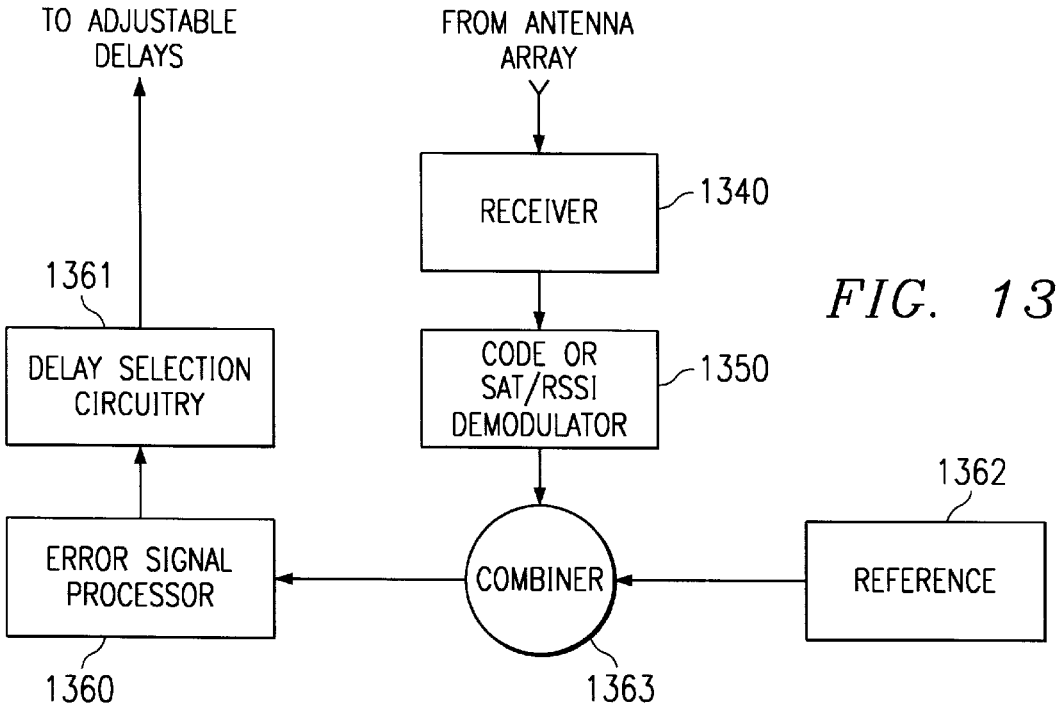
FIG. 13
FIG. 14
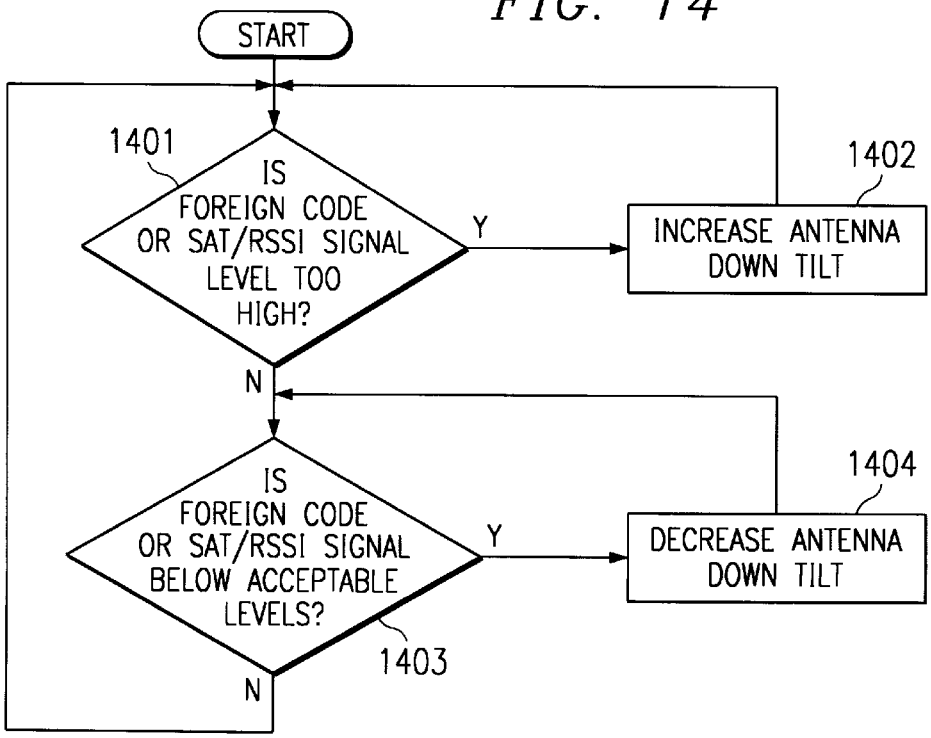

SYSTEM AND METHOD FOR PER BEAM ELEVATION SCANNING

REFERENCE TO RELATED APPLICATION

The present application is a continuation-in-part of commonly assigned U.S. application Ser. No. 08/808,304, now U.S. Pat. No. 6,094,166 entitled "CONICAL OMNI-DIRECTIONAL COVERAGE MULTIBEAM ANTENNA WITH MULTIPLE FEED NETWORK," filed Feb. 28, 1997, itself a continuation-in-part of commonly assigned U.S. application Ser. No. 08/680,992, now U.S. Pat. No. 5,940,048 entitled "CONICAL OMNI-DIRECTIONAL COVERAGE MULTIBEAM ANTENNA," filed Jul. 16, 1996, the present application is related to commonly assigned U.S. application Ser. No. 08/711,058, now U.S. Pat. No. 5,872,547 entitled "CONICAL OMNI-DIRECTIONAL COVERAGE MULTIBEAM ANTENNA WITH PARASITIC ELEMENTS," filed Sep. 9, 1996, co-pending and commonly assigned U.S. application Ser. No. 08/782,051, now U.S. Pat. No. 5,969,689 entitled "MULTI-SECTOR PIVOTAL ANTENNA SYSTEM AND METHOD," filed Jan. 13, 1997, co-pending and commonly assigned U.S. application Ser. No. 08/96,036, entitled "MULTIPLE BEAM PLANAR ANTENNA ARRAY WITH PARASITIC ELEMENTS," the disclosures of each of which five applications are incorporated herein by reference.

TECHNICAL FIELD OF THE INVENTION

This invention relates generally to a multibeam antenna array and more particularly to a system and method for providing elevation beam scanning on a per beam basis to provide electrical down-tilt for each antenna beam independently and for providing sidelobe level control for the antenna beams of the array as well as reduced wind loading.

BACKGROUND OF THE INVENTION

Often it is desirable to provide a plurality of directional predefined radiation patterns, or antenna beams, associated with an antenna structure of a wireless communication network. For example, in cellular telecommunications, including PCS systems, multiple substantially non-overlapping antenna beams are often utilized to provide communication throughout the area of a cell.

The multiple antenna beams of a communication system may be generated through use of a planar or cylindrical array of antenna elements, for example, where a signal is provided to the individual antenna elements having a predetermined phase relationship (i.e., a phased array). This phase relationship causes the signal simulcast from the various antenna elements of the array to destructively and beneficially combine to form the desired radiation pattern. There are a number of methods of beam forming using matrix type beam forming networks, such as Butler matrixes.

Controlling interference experienced in wireless communication, such as may be caused by multiple users of a particular service and/or various radiating structures of a service or different services providing communication coverage within the same or different geographical areas, is a concern. Moreover, as the use of wireless communications increases, such as through the deployment of new services and/or the increased utilization of existing services, the need for interference reduction schemes becomes more pronounced.

For example, in code division multiple access (CDMA) networks a number of communication signals, each associated with a different user or communication unit, operate over the same frequency band simultaneously. Each communication unit is assigned a distinct, pseudo-random, chip code which identifies signals associated with the communication unit. The communication units use this chip code to pseudo-randomly spread their transmitted signal over the allotted frequency band. Accordingly, signals may be communicated from each such unit over the same frequency band and a receiver may despread a desired signal associated with a particular communication unit.

However, despreading of the desired communication unit's signal results in the receiver not only receiving the energy of this desired signal, but also a portion of the energies of other communication units operating over the same frequency band. Accordingly, CDMA networks are interference limited, i.e., the number of communication units using the same frequency band, while maintaining an acceptable signal quality, is determined by the total energy level within the frequency band at the receiver. Therefore, it is desirable to limit reception of unnecessary energy at any of the network's communication devices.

In the past, interference reduction in some wireless communication systems, such as the aforementioned CDMA cellular systems, has been accomplished to an extent through physically adjusting the antenna array to limit radiation of signals to within a predefined area. Accordingly, areas of influence of neighboring communication arrays may be defined which are appreciably smaller than the array is capable of communicating in. As such, radiation and reception of signals is restricted to substantially only the area of a predefined, substantially non-overlapping, cell.

Changes in the environment surrounding a communication array or changes at a neighboring communication array may require adjustment of the radiation pattern of a particular communication array. Specifically, seasonal changes around a base transceiver station (BTS) site can cause changes in propagation losses of the signal radiated from a BTS. For example, during fall and winter deciduous foliage loss can cause a decrease in signal path loss. This can result in unintentional interference into neighboring BTS operating areas or cells as the radiation pattern of the affected BTS will effectively enlarge due to the reduced propagation losses.

Likewise, an anomaly affecting a neighboring BTS may cause an increase in signal path loss, or complete interruption in the signal, therefore necessitating the expansion of the radiation patterns associated with various neighboring BTSes in order to provide coverage in the affected areas.

Previously, crews have had to be dispatched to purposely tilt BTS antennas up or down to minimize interference or provide coverage in neighboring areas. Likewise, crews have again had to be dispatched when the anomaly affecting the signal has dissipated or been resolved. Such adjustment is typically accomplished in concert with observation of field measurement, such as may be available from drive testing or by the results of operation statistical records. It becomes readily apparent that compensation for such anomalies, even occurring only seasonally, can be quite expensive. Furthermore, as the communication system grows in complexity, more such adjustments have to be made to bring the system back up to full operating capacity.

Furthermore, physical adjustment of an antenna array, including the multiple beam forming arrays discussed above, suffers from additional undesired effects. For example, because the beams of such a multiple beam array are steered away from the broadside, physical down-tilt of a panel will not result in the same size radiation pattern for each of the multiple beams. Specifically, the antenna beams having a less acute angle from the broadside will result in a smaller radiation pattern as experienced on the surface than will the antenna beams having a more acute angle from the broadside.

Additionally, physical adjustment of the antenna array which produces the above mentioned multiple antenna beams necessarily results in adjustment of every one of the multiple beams. However, it may be desirable to independently adjust the beams. For example, the aforementioned anomaly affecting radiation of signals may affect only certain antenna beams of an array and, therefore, only a subset of the antenna beams require adjustment. Likewise, adjustment of only a selected antenna beam in order to provide communication to a particular mobile communication unit may be desirable. However, current systems do not provide for the adjustment of individual antenna beams of an antenna array.

Additionally, to improve communications it is often desirable to provide for higher gain at the antennas. A high gain antenna may provide a usable signal, where a lesser gain antenna may not, through such advantages as an improved signal to noise ratio for a desired signal. However, typically higher gain, such as with a planar panel antenna, results in a larger aperture area. Such a larger aperture, however, is often undesirable due to higher wind loading (higher air resistance). Moreover, larger aperture antennas are often unsuited for use in, for example, metropolitan areas where site aesthetics zoning are often of great concern.

Further control of interference and improvement in communications may be had through antenna beam side lobe control. Through side lobe control, substantially only desired areas may be included in the antenna beam, thus avoiding energy radiated from undesired directions in the receive link and radiating energy in undesired directions in the transmit link. However, often in the past antenna beam side lobe control has been accomplished through the removal of antenna elements in outer columns of the phased array. However, this solution results in a reduction in antenna aperture, and thus gain, as well as an undesirable power balance, i.e., the remaining elements are energized with more energy than the inner column elements if no attempt is made to reduce the total power to the outer columns.

If the power is not properly balanced among the antenna columns, such as providing the same excitation energy to each column of the array including the antenna columns having a reduced number of antenna elements, side lobe levels will increase. This is because the energy of with each antenna column will be divided among the antenna elements associated with the column. Where there are fewer antenna elements, each element will be provided more energy as compared to antenna columns having more antenna elements. Accordingly, providing a signal of equal power to each antenna column of a prior art array adapted for side lobe level control typically results in energization of the elements in an aperture distribution approaching an inverse cosine distribution. As will be appreciated by one of skill in the art, such aperture distribution applied to a typical prior art planar array produces substantial side lobe levels.

Prior art attempts to balance the power among such antenna columns introduce additional problems. For example, antenna feed systems which are adapted to compensate for the removal of the antenna elements are very complex. Attempting to compensate for the excess energy provided to the antenna columns having fewer antenna elements through such means as resistive loads to dissipate the energy introduce such problems as causing intermodulation products etc.

Accordingly, a need exists in the art for a system and method providing elevation "down-tilt" of an antenna array providing illumination of a predetermined area in order to reduce interference and allow frequency reuse by additional such antenna systems.

A further need exists in the art for a system and method allowing for simplified adjustment of elevation down-tilt of an antenna array.

A still further need exists in the art for a system and method which provide for automated elevation control of the various beams comprising a radiation pattern.

A yet further need exists in the art for a system and method providing elevation control of the various antenna beams of an antenna array on a per beam basis.

A further need exists in the art for a system providing improved antenna gain without resulting in undesired wind loading.

A still further need exists in the art for a system providing antenna beam side lobe control without substantially compromising antenna aperture. Additionally, a need exists in the art for antenna beam side lobe control which does not introduce problems with respect to power balancing between antenna elements of phased antenna columns.

SUMMARY OF THE INVENTION

These and other objects, features and technical advantages are achieved by a system and method which utilizes adjustable delays or phase shifts in the antenna array feed paths associated with the signals of each beam for which independent elevation scanning is desired. Accordingly, the antenna arrays, be they planar, cylindrical, or any other form suitable for providing multiple antenna beams, are divided into distinct and separate "phase-centers" so that a relative relationship can be established between these phase-centers. Relative phase differences between these phase centers are utilized according to the present invention to create the effect of beam steering.

Preferably, the phase-centers are associated with subdivisions of columns of antenna elements. Therefore, according to a preferred embodiment of the present invention, delays are introduced in the signals provided to ones of the antenna elements forming an antenna column. These delays set up a differential phase shift between the antenna elements. In the case where it is desired to have the antenna beam "look down" (down-tilt), the upper antenna elements of the column are advanced in phase in relationship to the lower antenna elements of the column. When the radiation of the upper elements is combined with the phase delayed energy of the lower portion of the column, the entire beam is steered down.

Preferably, multiple angles of down-tilt are accomplished by having the appropriate number of selectable delays or through provision of continuous delay adjustment. Accordingly, a system operator or system controller may choose a desired down-tilt by selecting the appropriate delays to be introduced between the antenna elements of the columns associated with the antenna beam to be adjusted. Selection of a particular down-tilt by the system operator or system controller preferably includes consideration of system wide interference levels, such as a determination of a particular amount of down-tilt at a cell site to provide adequate communications within a particular geographic area without accepting and/or introducing undesired energy from/into neighboring cells.

In a preferred embodiment, the introduction of selected delays are automated to provide for adjustment of down-tilt without substantial human intervention. Accordingly, a system controller may monitor communication conditions, including interference levels, at a particular base site or number of base sites and automatically adjust down-tilt to achieve desired communication attributes.

Of course, introduction of the selected delays may be through such manual means as a system technician physically altering the signal paths, if desired. Therefore, in the alternative to, or in addition to, the above mentioned automated adjusting of down-tilt, apparatus providing for the simplified manual adjustment of the electrical down-tilt is utilized. In a preferred embodiment, sets of easily removable and replaceable jumpers associated with predetermined amounts of down-tilt are provided to allow a service technician to easily adjust the down tilt of individual antenna beams. The use of such jumpers in combination with the aforementioned automatically adjusted down-tilt may be desirable, for example, where a planar array is deployed with a mechanical down-tilt. As described above, ones of the antenna beams of a mechanically tilted antenna array will be affected differently than others of the antenna beams. Accordingly, the jumpers may be introduced for particular ones of the antenna beams in order to compensate for the differences resulting from the mechanical down-tilt. Thereafter, the automated electrical down-tilt may adjust each antenna beam as deemed advantageous.

In the preferred embodiment, the phase-centers of the present invention are each associated with a beam forming feed network. Therefore, in addition to the provision of the signal having the proper phase relationship to the antenna elements in the horizontal component of the antenna array, i.e., each of the antenna columns, in order to destructively and beneficially combine to form the desired antenna beam azimuthally, phase shifts are introduced between antenna beam signals of each of these feed networks in order to steer the formed beam vertically. Accordingly, each antenna beam formed by the feed networks may be individually steered elevationally.

A preferred embodiment of the present invention utilizes a wind permeable, i.e., screened or gridded, ground plane as a reflector for the phased the array. Accordingly, wind load, or air drag, for the array is reduced because of the minimum air blockage caused by the, often substantial, surface area of the ground plane.

In order to further improve the wind load characteristics, a preferred embodiment of the inventive antenna system utilizes a feed system disposed directly in line with the radiating columns of the array. This provides for a wind profile of the combined components, both the column feed system and radiation elements, substantially the same as that of the radiation elements alone. It shall be appreciated that, as the radiation elements must be deployed in order to have an operable antenna system, therefore, this preferred embodiment provides a wind profile which approaches the minimum achievable.

A preferred embodiment of the present invention provides that the columns making up the antenna array be made up of individual "interlocking" columns such that the plurality of columns can be driven to give different overall azimuthal beam characteristics. An example of this may be a cellular base station along the corridor of an interstate highway, wherein it is desirable to have a number of narrow high gain beams pointing along the axis of the high-way. Such, a radiation effect could, for example, be attained by the interlocking together of eight radiation columns to create an overall array capable of producing a multiplicity of narrow, pencil like, beams for that particular application. If an application calls for a wider beam characteristic, two or even one such interlocking column(s) could be used to obtain the desired effect.

A preferred embodiment of the present invention provides that the beam forming networks be removed from the locality of the antenna array. Accordingly, this beam forming function may be present as fixed circuitry or as digitally controlled circuitry that is located at the base station enclosure or at an appropriate remote site, some arbitrary distance away from the main antenna structure. The purpose here is to remove the complexity of such circuitry from the individual interlocking columns and as such, these columns would be rather simple in overall complexity to build and manufacture.

A preferred embodiment of the present invention provides side lobe level control through the retardation of the propagation velocity of the electromagnetic energy being distributed along columns of a phased array. Preferably a dielectric material is placed between an air-line bus bar and the antenna column fed by the air-line bus bar, such as between the air-line bus bar and the back side of the ground plane. The retardation, and subsequent compression, of the wave length allows closer spacing of the antenna elements of the column fed by the dielectric line bus and, thus, allows the physical compression of the column. By retarding the propagation velocity of the electromagnetic energy being distributed along the outer columns, aperture tapering may be accomplished and, thus, side lobe level control may be realized.

Preferably, further tapering is achieved through the loading of the dielectric material with a lossy composite, such as carbon particles. Accordingly, lossy particles are suspended throughout the dielectric material with a particular density suited to the amount of side lobe control desired. Moreover, by utilizing various distributions of the lossy composite associated with a particular column, i.e., zoned dielectric substrates, further and more flexible side lobe level control may be achieved.

It shall be appreciated from the above that a technical advantage of the present invention is to provide elevation beam steering useful in reducing interference and allowing frequency reuse throughout a wireless communication system.

A further technical advantage of the present invention is provided by the system and method being adapted to allow for simplified adjustment of elevation down-tilt of the antenna beams.

Additionally, a technical advantage is provided by the present invention's ability to operate automatically, responsive to current wireless communication system operating conditions.

A further technical advantage is realized in the present invention's ability to provide independent elevation steering of multiple beams of a single antenna array.

A still further technical advantage of the present invention is provided in the ability to deploy an antenna array having desired attributes, such as a desired gain factor, without introducing a wind load which, for example, exceeds those of the available support structure or is otherwise undesirable.

Another technical advantage is found in the present invention's ability to provide antenna beam side lobe level control without causing unbalanced power distribution among the antenna elements of the array.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which:

FIG. 13 illustrates control circuitry for the automatic adjustment of down-tilt according to the present invention;

FIG. 14 illustrates the operation of the control circuitry of FIG. 13;

DESCRIPTION OF THE PREFERRED EMBODIMENTS

Figure 1:
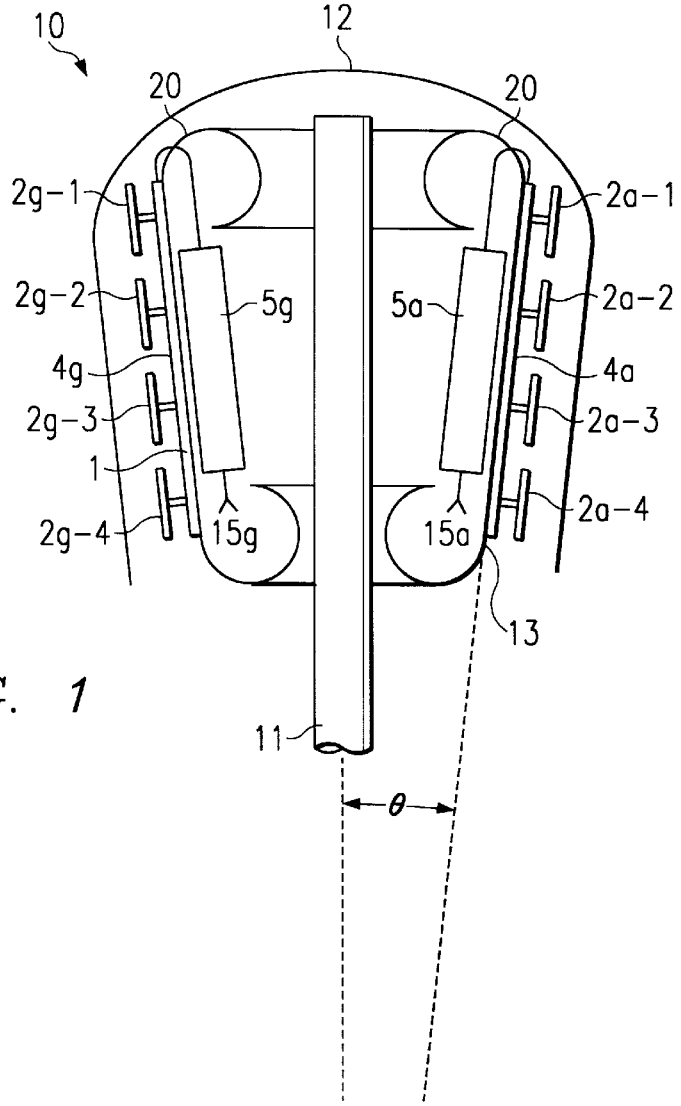
FIG. 1 illustrates a conical multi-beam antenna array suitable for use according to the present invention.
Figure 2:
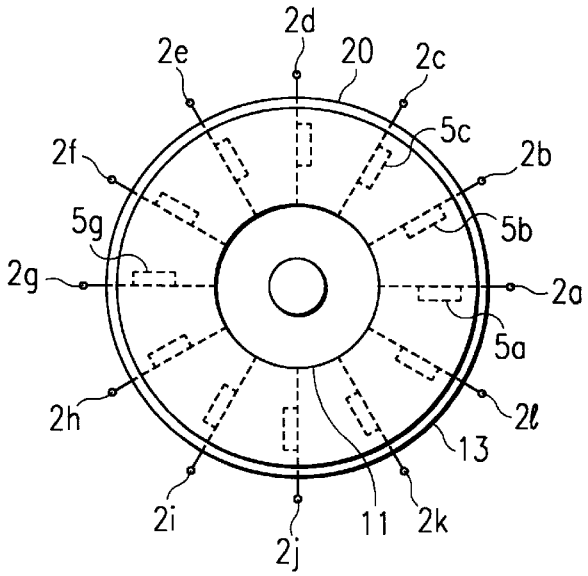
FIG. 2 illustrates a top view of the conical antenna array of FIG. 1.

As shown in FIG. 1, a preferred embodiment of an antenna array suitable for forming the antenna beams of the present invention is shown as antenna system 10 having ground surface 13, which in this embodiment is conical in shape, held by mast 11. Ground surface 13 acts as a reflector, as well as a, circumferential support for column radiators 2*a*–2*l* which are arranged around the peripheral of surface 13, as shown in FIG. 2. In the example shown, there are twelve vertical column radiators (2*a*–2*l*), each having 4 dipoles in this illustration, such as dipoles 2*a*-1, 2*a*-2, 2*a*-3 and 2*a*-4 for column 2*a* (FIG. 1). The column radiators are joined together by mounting them on a common feed system such as feed system 4*a* for radiator set 2*a* and feed system 4*b* for radiator 2*b* which in turn is connected by a coaxial connector (not shown) which feeds through the wall of conical ground surface 13 to a feed network associated with each column, such as feed networks 5*a*–5*l*.

A more detailed disclosure of the conical antenna system of FIG. 1 may be found in the above referenced applications entitled "Conical Omni-Directional Coverage Multibeam Antenna with Multiple Feed Network" and "CONICAL OMNI-DIRECTIONAL COVERAGE MULTIBEAM ANTENNA." An alternative embodiment of the conical antenna system of FIG. 1 is disclosed in the above referenced application entitled "CONICAL OMNI-DIRECTIONAL COVERAGE MULTIBEAM ANTENNA WITH PARASITIC ELEMENTS." However, as the present invention is directed toward the elevation steering of antenna beams provided by such an antenna system, and not the antenna system itself, only the basic structure of such antennas will be discussed herein with reference being made to the above referenced applications for a more detailed understanding of the antenna system itself.

Preferably, the feed networks of each radiator column are interconnected with the feed networks of other radiator columns, such as to provide desired beam forming. Directing attention to FIG. 3, a feed network wherein feed networks 5*a*–5*l* of radiator columns 2*a*–2*l* are interconnected, through the use of splitters and combiners 51*a*–*l*, 52*a*–*l*, and 53*a*–*l*, to form radiator column feed control network 300 controlling beam forming by exciting co-located columns.

In the case of a transmitter (TX), the energy enters at one or more of the coax connectors or inputs 15*a*–15*l*. For each connector, such as connector 15*c*, the energy is equally divided by divider 51*c*. The energy is split evenly and arrives at splitters 52*b* and 52*d*. That energy again is divided by splitter 52*b* coming out as 0° and −90°, and by splitter 52*d*, coming out as −90° and 0°. This energy is then routed to combiners 53*b*, 53*c*, 53*d*, and 53*e*, which illuminates or excites antenna columns 2*b*, 2*c*, 2*d* and 2*e*, respectively. The object is that energy enters connector 15*c* and is supplied to four antenna columns such that reading across from left to right the phase of the energy is at 0° at antenna 2*b*, −90° at antenna 2*c*, −90° at antenna 2*d*, and 0° at antenna 2*e*. This topology creates a beam, associated with a signal input at a particular input port, defined by four antenna columns which are illuminated in this manner.

Figure 3:
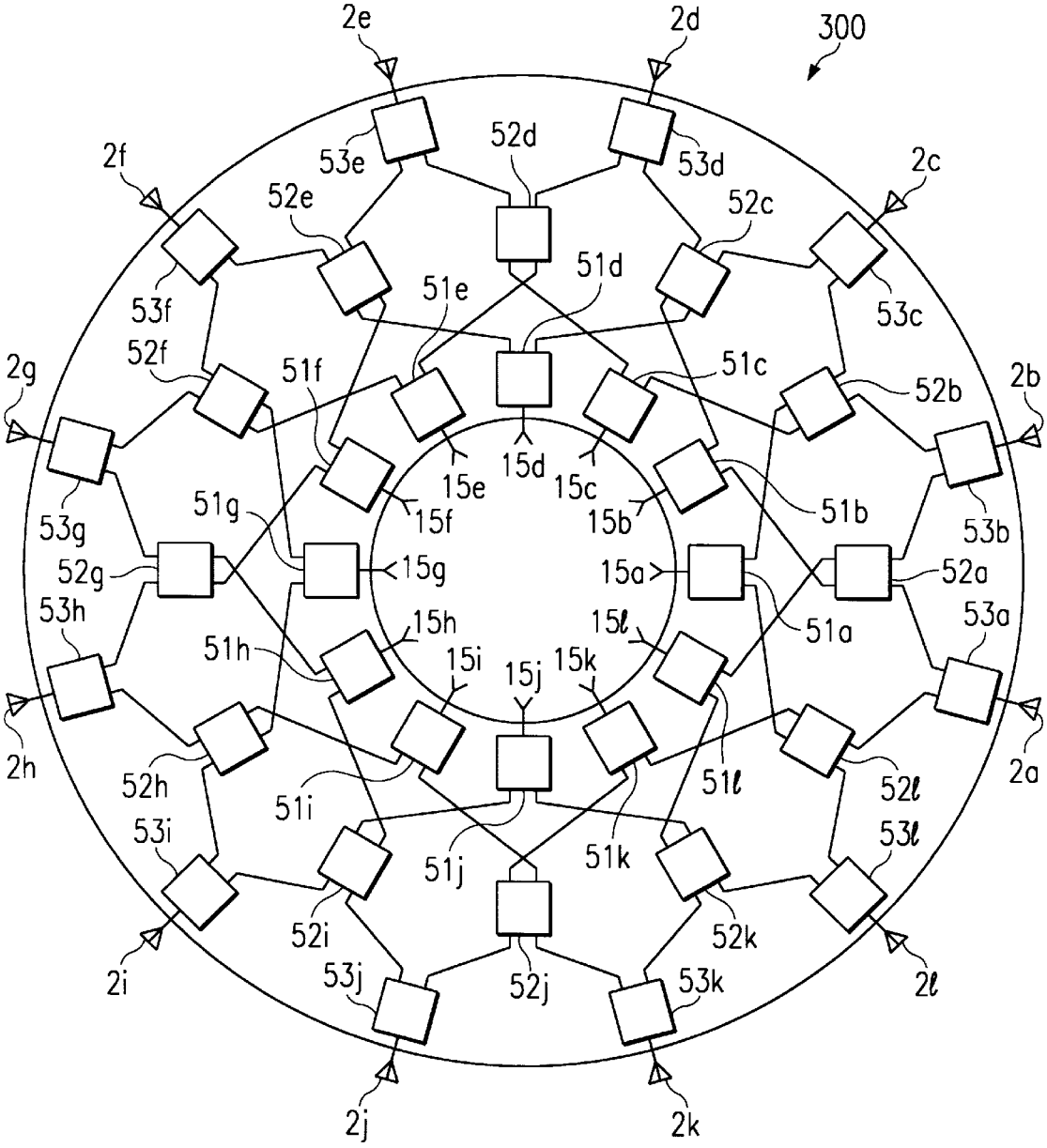
FIG. 3 illustrates an antenna beam forming feed matrix useful with the antenna array of FIG. 1.

Elements in FIG. 3, labeled 51*a* through 51*l*, are called "Wilkinson combiners." Each of the elements 51*a* through 51*l* have a single input, labeled as 15*a* through 15*l* respectively, which is divided into two outputs. Energy coming out of the elements is split but in phase. This is an in-phase power splitter. Elements 53*a* through 53*l* are also "Wilkinson combiners," although here they are disposed to perform oppositely to elements 51*a* through 51*l*, i.e., in the transmit signal path elements 51*a* through 51*l* operate to split a signal whereas elements 53*a* through 53*l* operate to combine signals.

Elements 52*a* through 52*l* have two inputs, associated with elements 51*a* through 51*l*, and two outputs, associated with elements 53*a* through 53*l*. One input is called "IN" and the adjacent one is called "ISO", or isolation. On the output side there is a terminal that is identified with 0° and one identified with −90°. When energy comes to the input port, going straight up, the output is 0°, going across to the other port, the output is −90°. If energy comes straight up from the isolation port, it is at 0° and energy crossing to the other port is −90°. This is called a hybrid combiner. The difference between the hybrid and the Wilkinson element is the fact that it has two inputs and the outputs have a 90° relationship with each other. That is essential to the forming of a desired antenna beam to communicate a signal associated with a particular input 15*a*–15*l* using the illustrated feed network.

Figure 4:
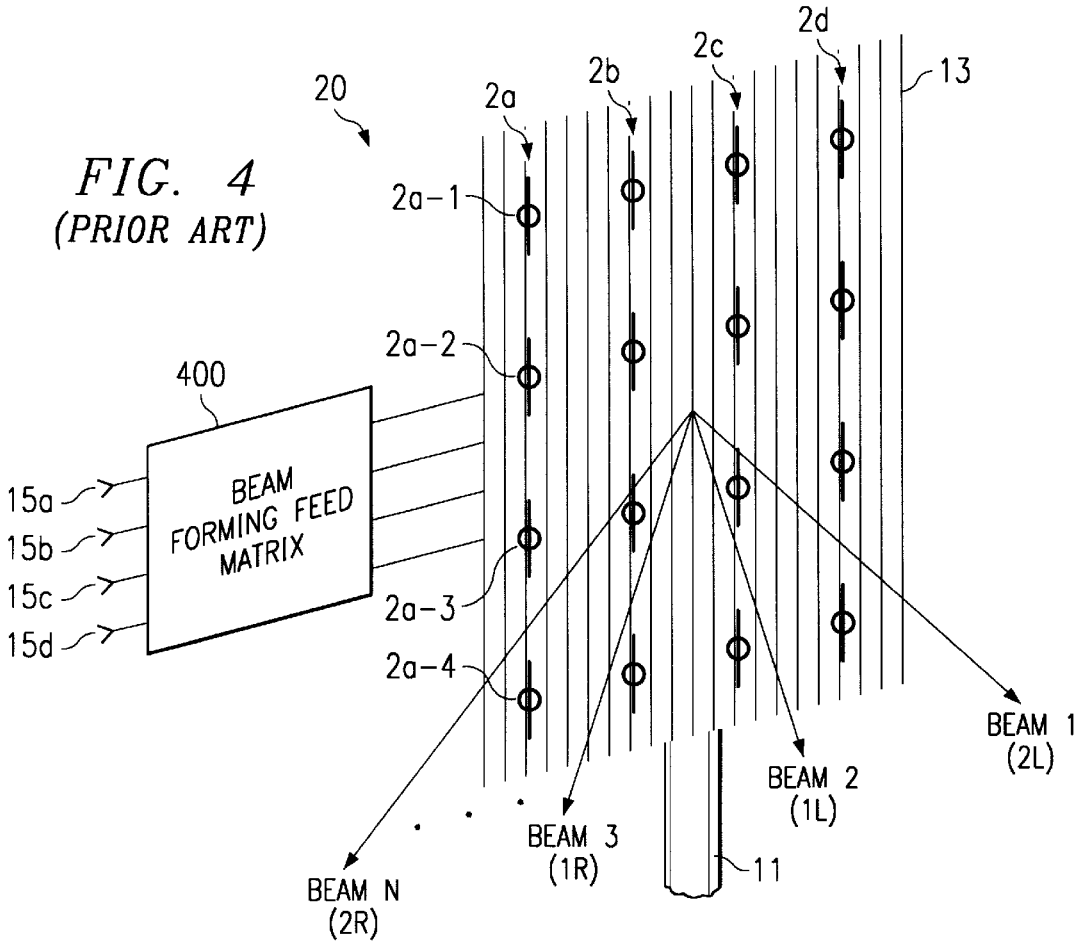
FIG. 4 (PRIOR ART)
FIG. 4 illustrates a planar multi-beam antenna array suitable for use according to the present invention.
Figure 5:
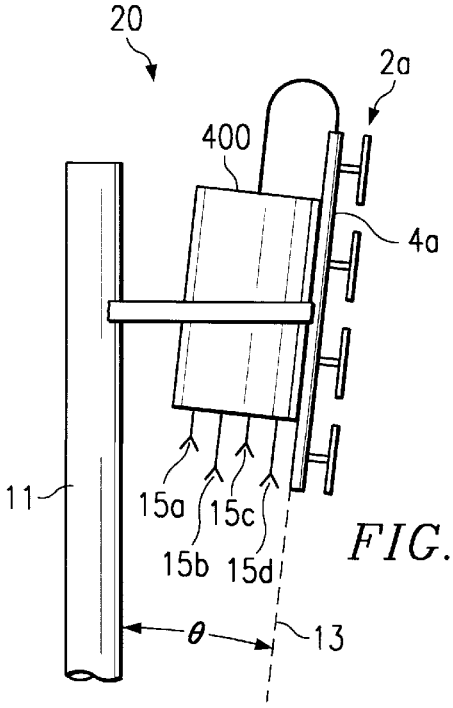
FIG. 5 illustrates a deployed planar antenna array having a mechanical angle of down-tilt.

Directing attention to FIG. 4, an alternative preferred embodiment of an antenna array suitable for forming the antenna beams of the present invention is shown as antenna system 20 having ground surface 13, which in this embodiment is planar, held by mast 11. Ground surface 13 acts as a reflector and support for column radiators 2*a*–2*d* which are arranged along one surface of ground surface 13, as shown in FIG. 5. In the example shown, there are four vertical column radiators (2*a*–2*d*), each having 4 dipoles in this illustration, such as dipoles 2*a*-1, 2*a*-2, 2*a*-3 and 2*a*-4 for column 2*a* (FIG. 4). The column radiators are joined together by mounting them on a common feed system such as feed system 4*a* for radiator set 2*a* which in turn is connected by a coaxial connector (not shown) which feeds through the wall of ground surface 13 to a feed network associated with each column, such as feed network 400.

A more detailed disclosure of planar antenna systems, such as that of FIG. 4, may be found in the above referenced applications entitled "Multi-Sector Pivotal Antenna System and Method" and "Multiple Beam Planar Antenna Array with Parasitic Elements." However, as the present invention is directed toward the elevation steering of antenna beams provided by such an antenna system, and not the antenna system itself, only the basic structure of such antennas will be discussed herein with reference being made to the above referenced applications for a more detailed understanding of the antenna system itself.

It shall be appreciated that feed network 400 of the antenna system of FIGS. 4 and 5 is substantially the same as that used in the antenna system of FIGS. 1 and 2. Specifically, feed network 400 operates to provide a signal at any of the inputs 15*a*–15*d* to the appropriate antenna columns 2*a*–2*d*, in a proper phase relationship, in order that destructive and beneficial combining of the radiated signals results in a desired antenna beam associated with the particular input. Accordingly, a signal at input 15*a* may be associated with an antenna beam having a predetermined shape and direction, such as beam 1 (beam 2L) illustrated in FIG. 4, through energization of any of columns 2*a* through 2*d* with a the signal having a proper phase relationship as provided by feed network 400.

In a preferred embodiment, feed network 400 is a Butler matrix wherein a signal provided at any of inputs 15*a*–15*d* is provided, having a proper phase relationship, at each of antenna columns 2*a*–2*d*. Accordingly, various signal splitters, combiners and hybrid combiners, as discussed above, are interconnected to form a Butler matrix providing the desired phase relationships between the signals input to and output from feed network 400.

Referring again to FIG. 1, ground surface 13 of conical antenna system 10 is shown having angle Θ with mast 11. Likewise, ground surface 13 of planar antenna system 20 is shown having angle Θ with mast 11 in FIG. 5. This angle Θ controls the area of coverage, i.e, the mechanical angle of down-tilt, and allows for reuse of the frequencies. Angle Θ could be variable, for example by tilting mast 11 or by tilting the antenna array, from time to time, to allow for changing conditions.

$$\Theta=\Theta_M+\Theta_E$$

The mechanical $\Theta_M$ is established by the physical structure of the antenna array, i.e., the acuteness of the right circular cone or amount of tilt of the planar antenna array. This $\Theta_M$ can be supplemented or replaced by a $\Theta_E$ which is an electrical down-tilt created by the relative phase relationship among the dipoles making up the vertical column.

Electrical down-tilt can be achieved if, for example, the radiator columns are fed in such a way that ones of the individual radiating elements making up the column radiator have the appropriate inter-element phase relationship in order that signals simulcast from the elements of a column destructively and beneficially combine to produce the desired amount of down-tilting. The radiating elements of a column identified with the above mentioned inter-element phase relationships may be thought of as providing a "phase-center," i.e., a single antenna element, or group of vertically co-located antenna elements, of a column being provided a signal having a predefined phase relationship with respect to other antenna element(s) of the column each provide a particular phase-center. Accordingly, a relative phase relationship is established between the phase-centers of the column. It is these relative phase differences between the phase centers that creates the effect of beam steering or electrical down-tilt.

Electrical down-tilt as described above may be expressed mathematically as shown below:

$$F(\Theta) = \sum |a_n| \exp(jnd_x k_0(u - u_0))$$

$$\text{where } u_0 = \sin(\Theta_0)$$

This expression implies the use of phase shifters to set the complex weights $\alpha_n$. The equation shows that the array factor is a function of $\mu-\mu_O$, such that if the array is scanned to any angle Θ, the pattern remains unchanged except for a translation. This is the main reason for the use of the variables $\mu$ and ν (often called sine space or direction cosine space) for plotting generalized array patterns.

Figure 6:
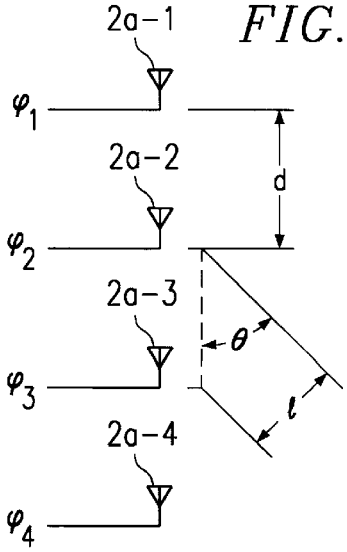
FIG. 6 illustrates an electrical angle of down-tilt accomplishable with a column of antenna elements such as those of the conical antenna array of FIG. 1 and the planar antenna array of FIG. 4.

However, in order to more easily understand scanning of the antenna beams according to the present invention, reference is made to FIG. 6, wherein the interrelationship of antenna elements of an antenna column is shown, and to the following equations utilizing the inter-relationship of the antenna elements to determine electrical down-tilt. FIG. 6 illustrates the interrelationship of the antenna elements 2*a*–1 through 2*a*–4 of column 2*a*. In the preferred embodiment, the antenna elements of a column are equally spaced distance d apart. Of course, antenna elements may be non-uniformly spaced, if desired, however it shall be appreciated that such spacing adds to the complexity of determining the proper phase relationships of the various elements.

The amount of electrical down-tilt is shown as angle Θ. In the illustrated case $\Theta=\Theta_E$, $\Theta_M=0$. However, it shall be appreciated that a different value for $\Theta_M$ may be selected which would simply be added to the amount of electrical down-tilt in order to determine the total amount of down-tilt associated with an antenna beam.

The following definitions are useful in describing and understanding phase scanning as illustrated in FIG. 6 and as shown in the following mathematical relationships:

$\phi_S$=Electrical Degrees of Phase Shift (i.e., the phase shift in the feed system to each antenna element)

γ=Differential Phase Shift (also referred to as space angel) where $\phi_1-\phi_2=\phi_2-\phi_3=\phi_3-\phi_4$ d=Inter-Element Spacing λ=Free Space Wavelength Θ=Beam Position Relative to Broadside l=Angularly Displaced Inter-Element Spacing where l=d(sin Θ)

As illustrated in FIG. 6, each of the antenna elements 2*a*-1 through 2*a*-4 of antenna column 2*a* are provided a signal having a phase shift relative to the signal of a co-located antenna element. Through the following relationships, it is possible to predict the angle Θ, or amount of electrical down-tilt, associated with any selected differential phase shift γ.

$$\sin(\Theta) = \frac{l}{d}$$

$$\frac{\gamma}{2\pi} = \frac{l}{\lambda}$$

$$\sin(\Theta) = \frac{\gamma\lambda}{2\pi d}$$

$$\Theta = \arcsin\left(\frac{\gamma\lambda}{2\pi d}\right)$$

From the above, it becomes readily apparent that, through proper selection of a differential phase shift γ between the antenna elements, a desired amount of down-tilt Θ may be selected.

Ideally, each element, in tie preferred embodiment dipoles, has their own phase shifter, and thus phase-center, associated therewith. However, the use of individual phase shifters for each antenna element increases the complexity and cost of the antenna array feed system. Therefore, a preferred embodiment of the present invention utilizes phase-centers associated with of sub-groups of antenna elements.

In the preferred embodiment phase shifters are utilized, not for each individual antenna element, but for a sub-group of antenna elements including a plurality of co-located antenna elements in an antenna column. Accordingly, a reduced number of phase shifters are necessary as a plurality of co-located antenna elements are provided a same phase shifted signal from a common phase shifter.

Where the phase centers of each of the sub-groups of antenna elements are not excessively spread apart, acceptable scanning is accomplished within a limited scan extent. For example, as long as the electrical down-tilt is restricted to within 10° of normal to the broadside, the resulting beam quality is acceptable for most typical applications. Of course, 10° of electrical down-tilt is not a limitation of the present invention. Indeed, any amount of down-tilt may be provided utilizing the present invention, understanding that beam quality will be more severely impacted the further from broadside a beam is steered. However, where acute angles of down-tilt are desired, the phase centers of the present invention may be disposed more closely together, such as through placing the antenna sub-groups of each phase-center more closely together or through the use of phase shifters associated with each antenna element of the antenna column. Additionally, additional down-tilt may be provided mechanically as described above.

For example, in the antenna systems of FIGS. 1 and 4, the antenna element spacing may be approximately λ. Inter-element spacing of approximately a wavelength is generally acceptable as, where no elevation scanning is being done, there is no need to worry about grating lobes. However, since the present invention performs elevation scanning, it is advantageous to reduce the inter-element spacing for suppression of grating lobes.

Accordingly, a preferred embodiment of the present invention utilizes an inter-element spacing of 0.6 λ in order to suppress grating lobes. However, it shall be appreciated that, since the antenna elements are spaced closer together in this preferred embodiment, a reduction in antenna gain is experienced over that of an array where the antenna elements are spaced further apart. This reduction in gain is due to the effective area of the antenna, or aperture, being reduced.

To compensate for the above described aperture reduction, it may be desirable to add additional antenna elements per column to increase the effective area of the antenna system. For example, in a preferred embodiment, where an antenna array initially consisting of columns of four elements having inter-element spacing of approximately λ is adapted to utilize the per beam elevation steering of the present invention, columns of six elements having inter-element spacing of approximately 0.6 λ are utilized to provide substantially the same aperture.

Computer modeling has indicated that the addition of eight dipole antenna elements to a four column antenna array, originally having four columns of four dipole antenna elements each spaced approximately 0.6 λ apart, results in a gain increase of approximately 1.4 dB. However, it shall be appreciated that the smaller antenna array, utilizing fewer antenna elements per column, lends itself to easier handling and less wind loading. Of course, as discussed above, the smaller antenna array has the disadvantage of lower gain. Moreover, in the embodiments described above, the smaller antenna has an elevation scan extent of ±4° from normal, whereas the larger antenna array of twenty-four dipole antenna elements (four columns of six antenna elements each) provides a wider elevation scan extent of approximately ±7° from normal. The elevation scan extent discussed above for each system is the point at which the grating lobe associated with the angle of down-tilt reaches 9 dB. This limit is an arbitrary standard and is not a limitation of the present invention, but rather is a benchmark by which to compare the antenna beams formed.

Figure 15:
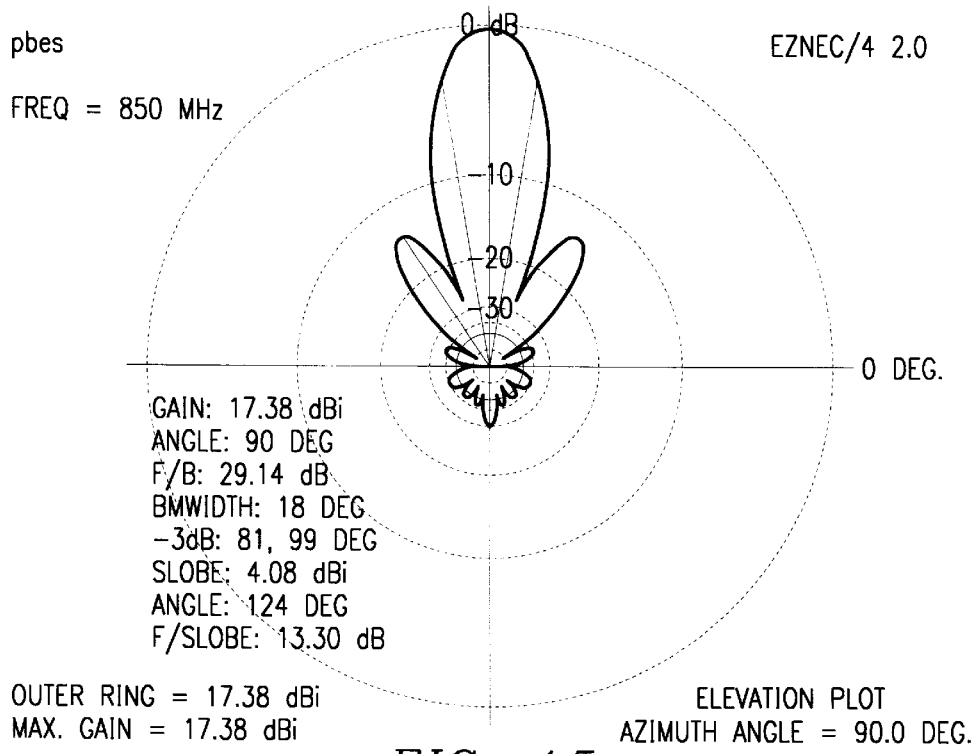
FIGS. 15–18 illustrate the elevation beam-width characteristics of antenna arrays adapted for use according to the present invention.
Figure 16:
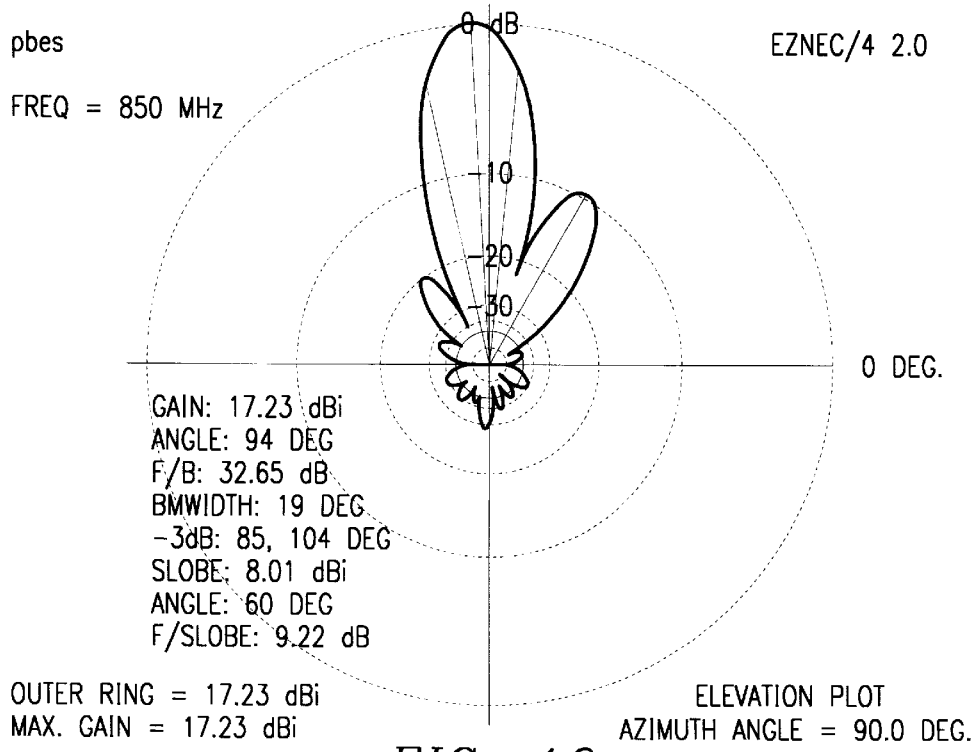
Figure 17:
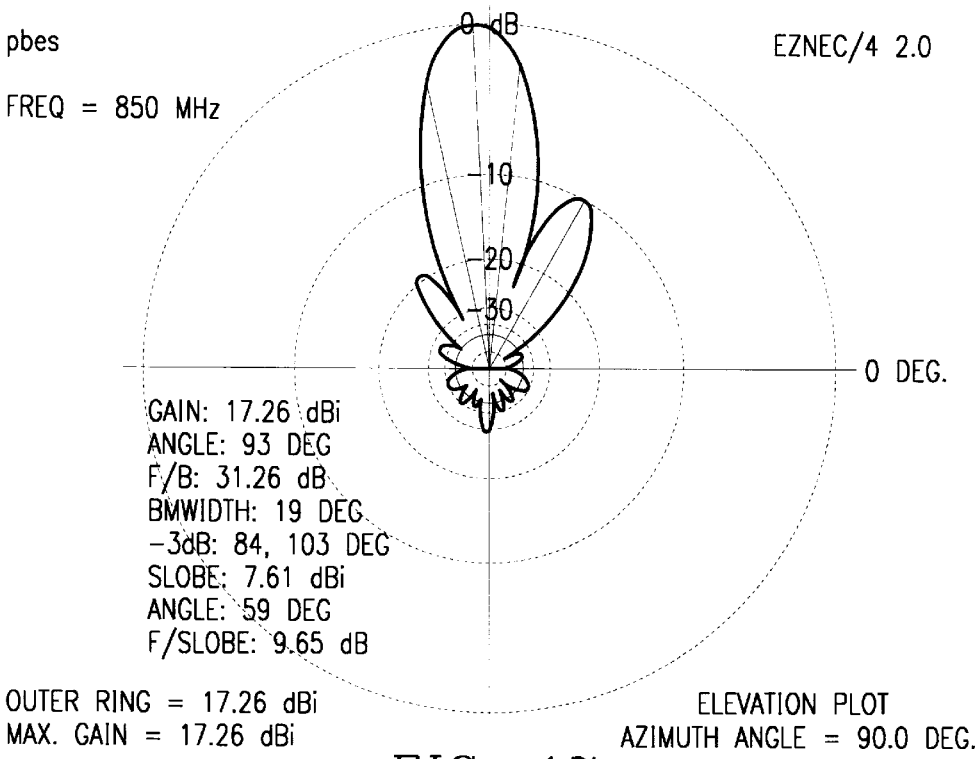
Figure 18:
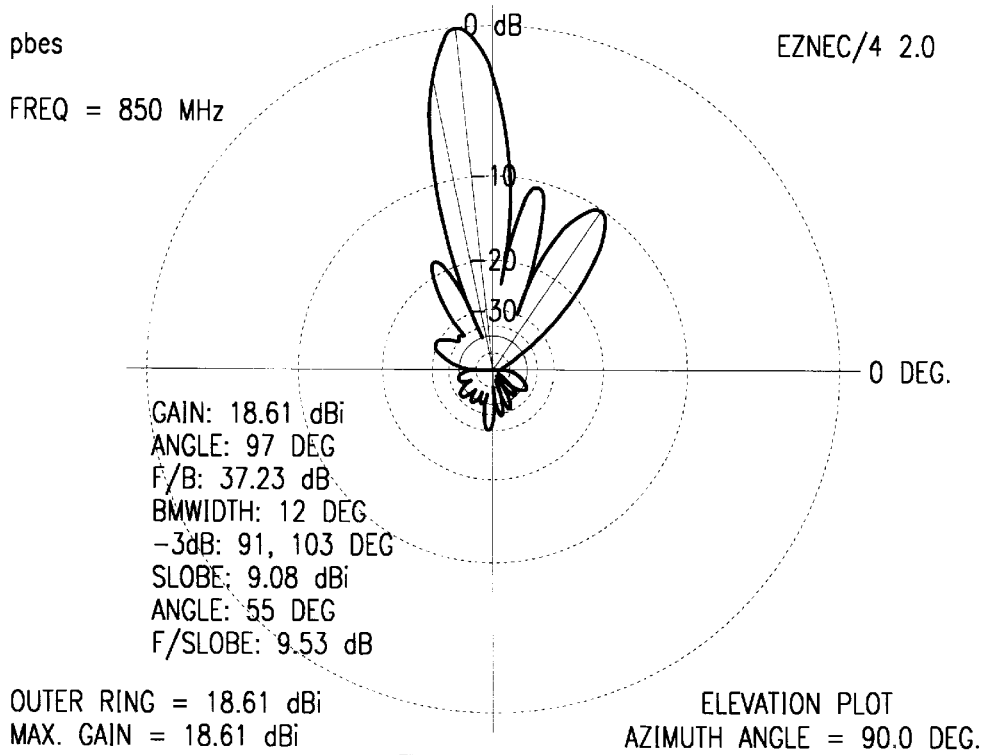

Directing attention to FIGS. 15–18, plots of the elevation beam width characteristics of the above antenna array configurations are shown. FIG. 15 shows the elevation beam width characteristics of the smaller antenna array discussed above when the electrical down-tilt angle Θ is zero. FIG. 16 shows the elevation beam width characteristics of the smaller antenna array when the electrical down-tilt angle Θ is 4° (note the occurrence of the grating lobe at 60°). FIG. 17 shows the elevation beam width characteristics of the small antenna array when the electrical down-tilt angle Θ is 3° (note that the grating lobe is decreased by ½ dB). FIG. 18 shows the elevation beam width characteristics of the larger antenna array discussed above when the electrical down-tilt angle Θ is 7° (note the occurrence of two grating lobes created by the additional phase-center).

It is anticipated that the electrical down-tilt of the present invention shall be utilized in conjunction with a multi-beam array, i.e., electrical down-tilt will be provided for various antenna beams of the antenna array to provide per beam elevation beam steering. Accordingly, the phase-centers, associated with antenna elements energized with a signal having the same phase, are not simply associated with co-located antenna elements of a single column, but include antenna elements of adjacent antenna columns. In explanation, where a particular antenna beam is formed through energizing four antenna columns, as illustrated in the feed network 300 of FIG. 3, elements from each of these columns will be associated with a particular phase center. For example, a signal provided to input 15*b* will energize elements of each of antenna columns 2*a*, 2*b*, 2*c*, and 2*d* in order to form an antenna beam of a desired azimuthal shape. Therefore, in order to provide a properly formed antenna beam having a desired angle of down-tilt, each of antenna columns 2*a*, 2*b*, 2*c*, and 2*d* will be divided into sub-groups associated with the above described phase centers.

The phase centers, described above with respect to conical antenna system 10 of FIG. 1, are equally applicable to the planar antenna system 20 of FIG. 4. Moreover, the interconnection of the antenna elements to provide the per beam elevation steering of the present invention is more easily illustrated and described in relation to a planar antenna such as that of FIG. 4. Accordingly, attention is directed to FIG. 7 wherein a planar multi-beam array adapted according to the present invention is illustrated.

Figure 7:
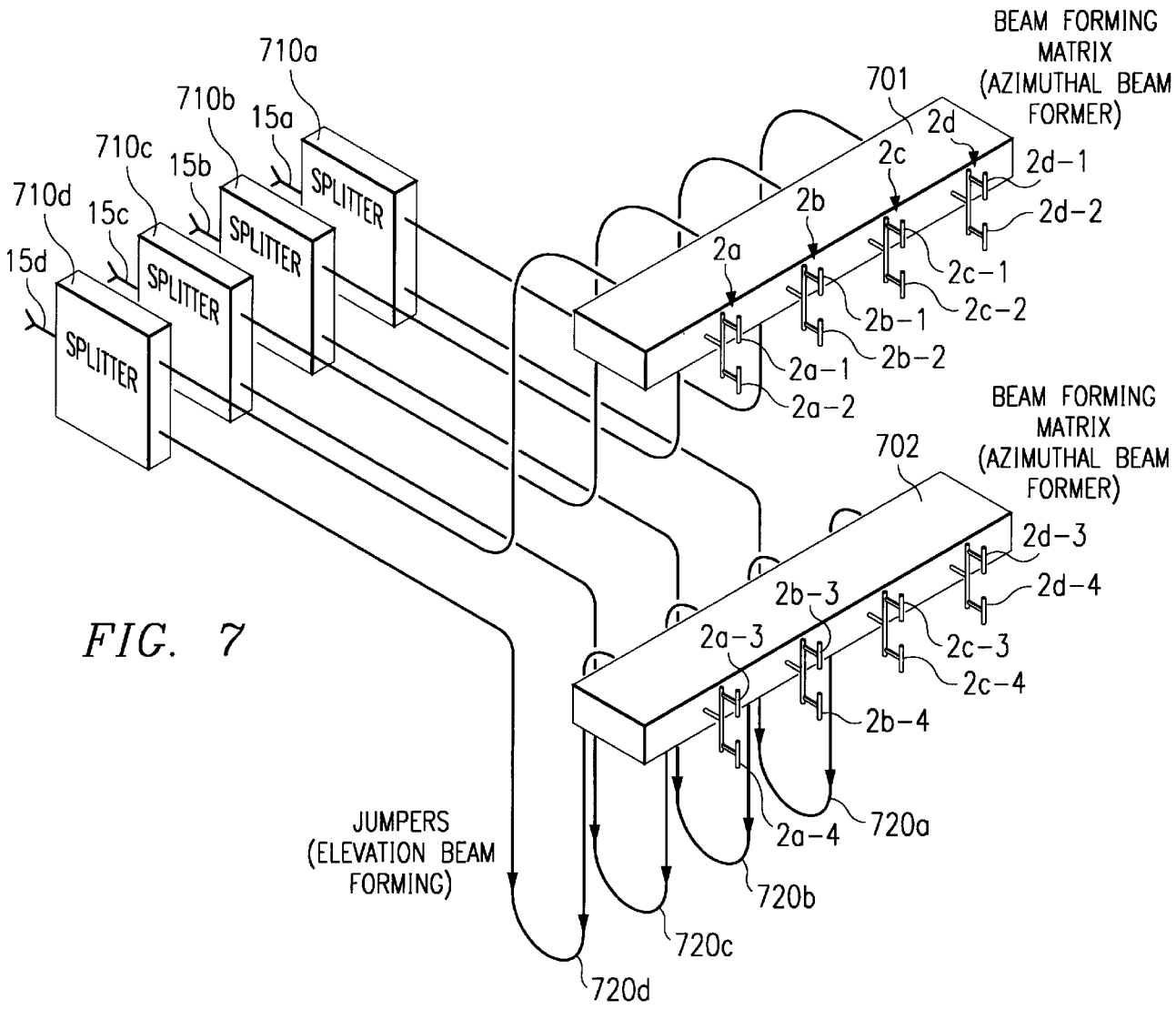
FIG. 7 illustrates circuitry providing an electrical angle of down-tilt according to a preferred embodiment of the present invention.

In FIG. 7, the antenna elements of columns 2*a*–2*d* are divided into sub-groups as described above. Accordingly, antenna elements 2*a*-1 and 2*a*-2 are a sub-group of antenna column 2*a*. Likewise, antenna elements 2*a*-3 and 2*a*-4 are another sub-group of antenna column 2*a*. The elements of antenna columns 2*b*–2*d* are similarly divided into sub-groups.

Preferably, the antenna beam forming feed matrixes 701 and 702 of FIG. 7 are the same, i.e., each of feed matrix 701 and 702 provide the same output phase relationship at its various outputs in response to a signal provided to any of its inputs as does the other feed matrix. In the preferred embodiment, feed matrixes 701 and 702 are Butler matrixes as described above with respect to feed matrix 400 of FIGS. 4 and 5. Accordingly, although signals input at each of inputs 15*a*–15*d* are split, through the use of splitters 710*a*–710*d*, for separate provision to feed matrixes 701 and 702, each feed network establishes the appropriate differential phase progression between antenna columns in the azimuthal plane. Therefore, beam forming, such as described above with respect to beams 2L, 1L, 1R, and 2R of FIG. 4, remains unaffected. However, as the input signal is split for separate provision to the phase-centers, a phase differential may be introduced into the signal paths of individual antenna beam signals in order to achieve the per beam elevation steering of the present invention.

Still referencing FIG. 7, it can be seen that jumpers 720*a*–720*d* introduce an additional length of transmission cable into the signal paths of signals input at inputs 15*a*–15*d* associated with feed matrix 702 not found in the signal paths associated with feed matrix 701. Accordingly, a phase lag is introduced in the antenna beam signals of antenna elements 2*a*-3, 2*a*-4, 2*b*-3, 2*b*-4, 2*c*-3, 2*c*-4, 2*d*-3, and 2*d*-4, the antenna elements of the lower phase-center, and antenna elements 2*a*-1, 2*a*-2, 2*b*-1, 2*b*-2, 2*c*-1, 2*c*-2, 2*d*-1, and 2*d*-2, the antenna elements of the upper phase-center. This phase lag provides the phase differential, γ, between the phase-centers of the present invention and, thus, provides the electrical down-tilt. For example, the angle of down-tilt Θ may be selected by using a jumper 720 of proper length to introduce a particular phase shift γ through referencing the mathematical relationships above.

It shall be appreciated that although illustrated as different lengths, the length of the signal paths of each of input signals 15*a*–15*d* are preferably the same with the exception of introduction of additional signal path length by jumpers 720*a*–720*b*. Accordingly, in the preferred embodiment, jumpers 720*a*–720*b* are predetermined lengths of cable adapted for easy insertion into and removal from the signal paths, such as through the use of coaxial connectors, for adjusting signal phase as provided to each of the phase-centers. Therefore, the phase of a signal input at inputs 15*a*–15*d* as appears at each of the antenna sub-groups may easily be controlled to have a proper phase progression with respect to any co-located antenna subgroup. Of course, differences in signal path lengths, as well as other factors resulting in an undesired phase differential, may be compensated for, through the use of adaptive circuitry such as might be disposed in the beam forming matrixes utilized by the present invention.

As described above, each input 15*a*–15*d* of the beam forming feed matrixes of the present invention is associated with a particular antenna beam formed by the antenna array. Accordingly, a signal input at input 15*a* will be provided in a particular antenna beam, for example beam 2L (FIG. 4), whereas a signal input at input 15*b* will be provided in another antenna beam, for example beam 1L. Therefore, the phase differential γ associated with jumper 720*a* will only affect the elevation beam steering of the antenna beam associated with the corresponding input signal 15*a*. As such, jumpers 720*a*–720*d* may be individually selected/adjusted and, thus, each antenna beam, although emanating from the same antenna array, individually steered elevationally, i.e., per beam elevation scanning.

It shall be appreciated that the present invention is not limited to the two phase-centers illustrated in FIG. 7. Any number of phase-centers may be provided, such as through the expedient of replicating the circuitry of one of the illustrated phase-centers. For example, splitters 710*a*–710*d* may provide a 1:3 split of input signals where the third split is provided to a third beam matrix (not shown) associated with an additional sub-group of eight antenna elements (not shown) disposed below those of the lower sub-group of FIG. 7. Of course, the phase shifters, in a preferred embodiment jumpers, placed in the signal path of this additional phase-center would introduce a phase differential γ over that of the lower sub-group of FIG. 7 and, thus, introduce a phase differential 2 γ over that of the upper sub-group of FIG. 7 (assuming equal spacing of the phase-centers of the antenna array).

The use of more phase-centers than illustrated in FIG. 7 may be desirable where, as described above, the vertical placement of the antenna elements of the various phase-centers are compressed when utilizing elevation steering according to the present invention in order to control grating lobes. Accordingly, in order to increase the aperture of the antenna array, additional antenna elements may be provided as described above. However, the use of such additional phase-centers requires additional beam formers, more internal cables, and additional phase shifters. Accordingly, in order to adjust the down-tilt of one of the antenna beams utilizing additional phase-centers, adjustment must be made to multiple phase shifters rather than the one associated with that particular antenna beam illustrated in FIG. 7.

Figure 8:
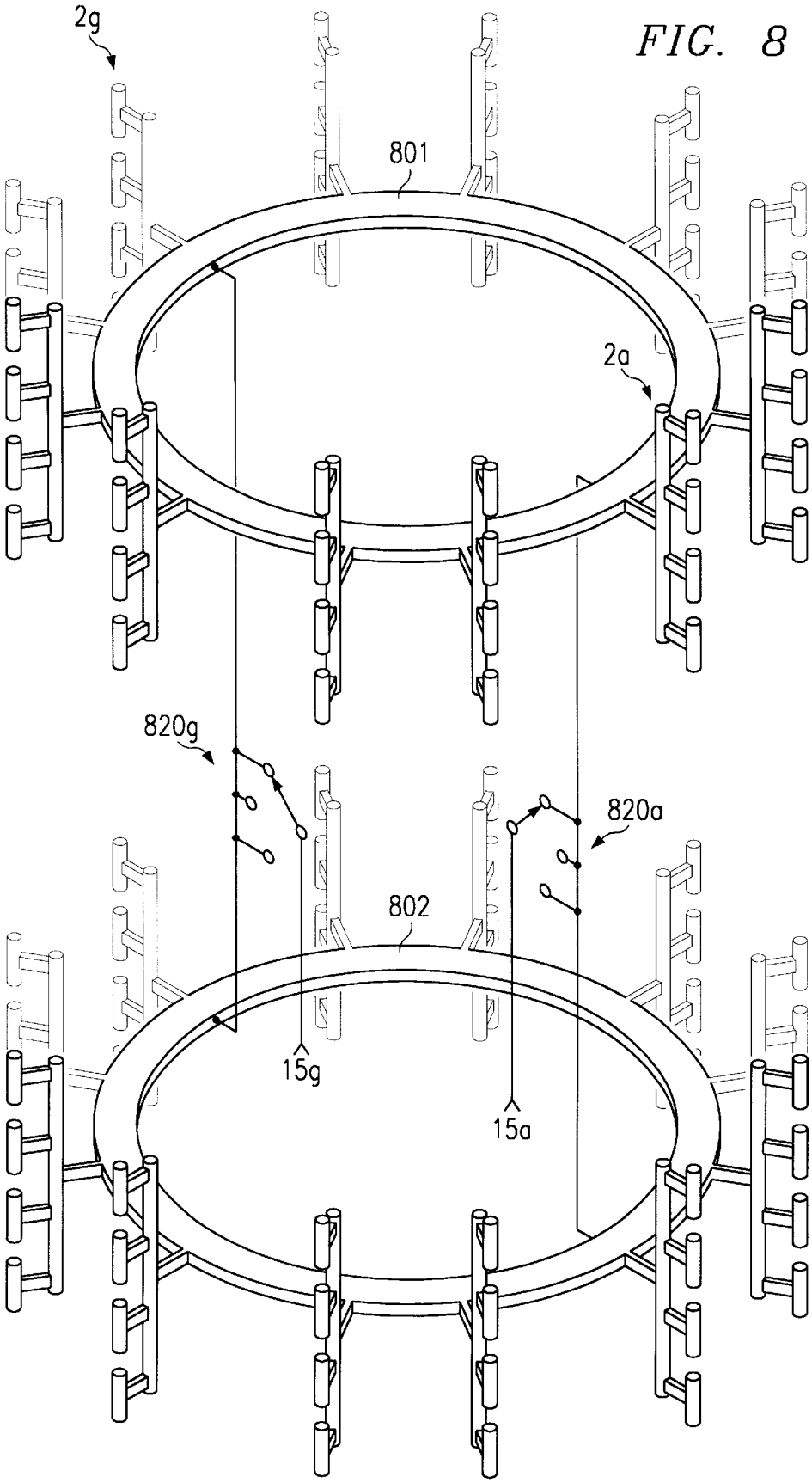
FIG. 8 illustrates circuitry providing an electrical angle of down-tilt according to an alternative embodiment of the present invention.

Additionally, as discussed above, a phase-center may be associated with a sub-group consisting of any number of antenna elements. For example, FIG. 8 shows two sub-groups of antenna elements including four vertically placed antenna elements, rather than the two vertically placed antenna elements illustrated in FIG. 7. Of course, because the phase-centers associated with the sub-groups of FIG. 8 will necessarily be farther apart, assuming that the same size/type of antenna elements are utilized, the beam formed will be more significantly affected at a same displacement angle Θ than will the beam formed from the system of FIG. 7.

The limit of the number of such sub-groups is dependent on the individual number of elements making up the antenna column, i.e., each individual antenna element may comprise a subsection according to the present invention. However, a minimum of two such subsections are required to affect any electrical down-tilt.

Also shown in FIG. 8 is an alternative embodiment of a signal feed system producing electrical down tilt. To provide the desired electrical down-tilt according to this embodiment, coaxial switches, such as switches 820*a* and 820*g*, are adapted to select a "tap" position along a common feed line that connects the radiator column subsections to a common signal. These tap locations are disposed at predetermined positions along the common feed line to provide selectable differential phase shifts between the sub-groups energized by the input signal. For example, a tap location may be selected at a point in the common feed line being equidistant from each sub-group. The input of a signal at this tap position, as selected by the switch associated with the radiator column, would provide an in phase signal to each sub-group and thus result in a beam orthogonal to the excited column, i.e., no down-tilt.

However, in the case where it is desired to have the antenna beam "look down" (down-tilt), the upper sub-group is advanced in phase through the use of a tap location selected at a point in the common feed line providing a shorter signal path to the upper sub-group than the lower sub-group. When the radiation from the upper sub-group is combined with the phase delayed energy of the lower sub-group the entire beam is steered down. It shall be appreciated that the greater this phase differential, the greater the down-tilt. Therefore, multiple angles of down-tilt are accomplished by having the appropriate number of tap locations.

It shall be appreciated that FIG. 8, in addition to showing an alternative embodiment of the sub-grouping of antenna elements, illustrates a conical antenna system such as that of FIG. 1 adapted to provide per beam elevation scanning according to the present invention. Feed matrixes 801 and 802 are feed matrixes substantially as illustrated in FIG. 3, although for clarity ones of the input signal paths have not been illustrated. Accordingly, it can be seen that the present invention is adaptable to antenna systems other than the planar array illustrated in FIG. 7.

Figure 10:
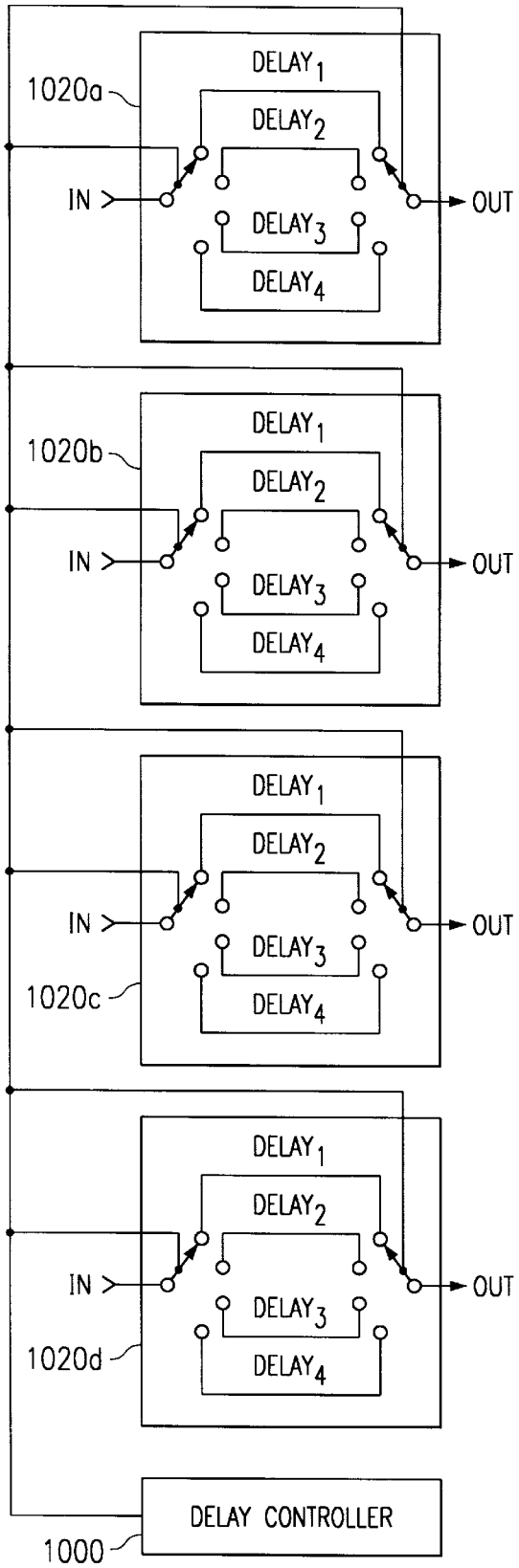
FIGS. 10 and 11 illustrate alternative embodiments of delay circuitry utilized in providing an electrical angle of down-tilt according to the present invention.

Moreover, other embodiments of adjustable delay devices to introduce differing delays may be utilized. One embodiment of adjustable delay devices is shown in FIG. 10. Here, different lengths of cable, much like the jumpers of FIG. 7, are switched into the signal paths to provide adjustable delays. Of course, the switching of these delays may be through the use of PIN diodes, if desired. It shall be appreciated that delays 1020*a*–1020*d* may be associated with the signal paths of each antenna beam signal. For example, delay 1020*a* may be provided in the signal path associated with input 15*a* of FIG. 7 in place of jumper 720*a*. Likewise, each of delays 1020*b*–1020*c* could be provided in the signal paths in place of jumpers 720*b*–720*c* respectively. Accordingly, each of the antenna beams may be individually steered elevationally. For example, by selecting delay, at delay 1020*a* and $\text{delay}_2$ at delay 1020*b*, antenna beam 2L and antenna beam 1L may each be provided with a differing amount of down-tilt.

Figure 11:
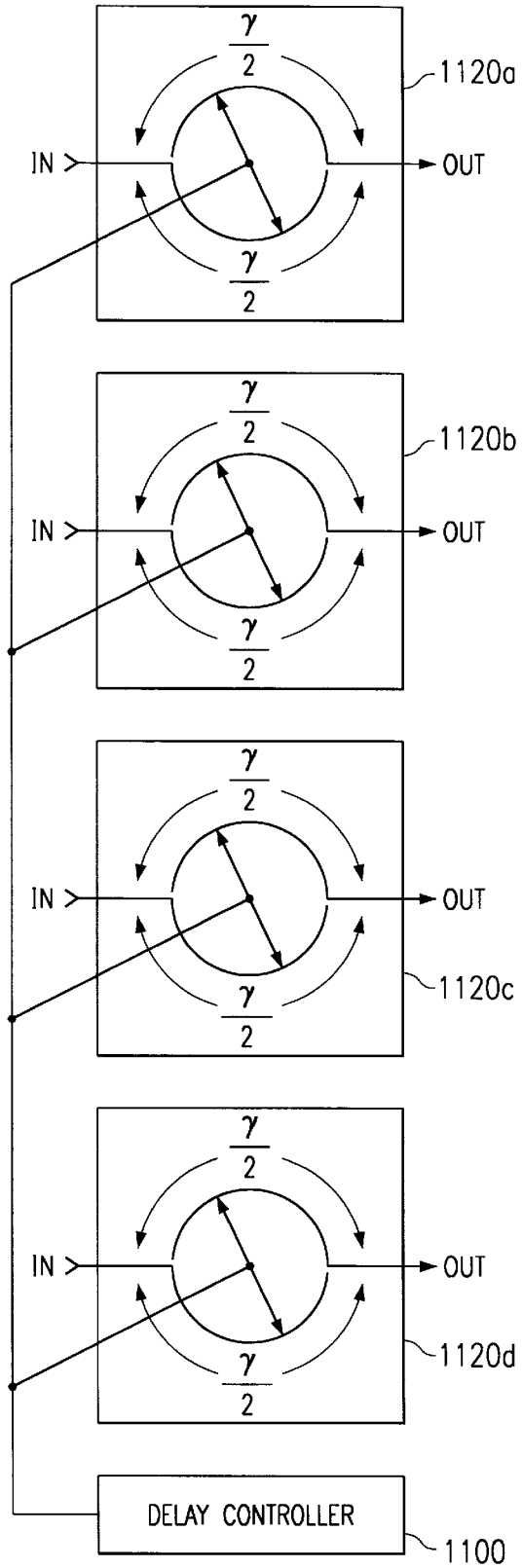

An alternative embodiment of the variable delay devices are shown in FIG. 11. Here a delay is selected by rotating the tap of each delay device to utilize a different length of signal path. It shall be appreciated that the phase shift introduced by each delay device 1120*a*–1120*d* of this embodiment is associated with each of the antenna beam signal paths as described above with respect to delays 1020*a*–1020*d*.

As shown above, the phase shifters of the present invention are not limited to the different lengths of signal paths configured as removable jumpers illustrated in FIG. 7. A phase difference in the signal provided to each subsection of a column may be introduced by any delay or phase shifting means deemed advantageous. For example, a surface acoustic wave (SAW) device may be placed in the signal path of the lower phase-center to introduce a signal delay and thus retard the arrival of energy at that phase-center in comparison to the upper phase-center, therefore causing the combined radiation of the column to tilt downward. Alternatively, differing lengths of coax cable feeding the radiator column sub-groups may be used to introduce the desired phase differential. Likewise, in-phase and quadrature (I/Q) signal combiners may be utilized to provide a desired phase differential in the signal of a sub-group.

Of course, where more phase-centers than the two illustrated in FIG. 7 are used, delays associated with the additional phase-centers must also be used. Such additional delays may be provided by simply replicating the adjustable delays, such as those illustrated in FIG. 10, for each of these additional phase-centers. Of course, the delays associated with these additional delays are incrementally increased with respect to those illustrated in order to provide the above described phase progression, i.e., in a second set of adjustable delays a first delay corresponding to $\text{delay}_1$ might be twice that of $\text{delay}_1$. Of course, any delays determined to be beneficial may be utilized, if desired.

Also as described above, where more phase-centers than the two of FIG. 7 are required, additional delays 1120*a*–1120*d*, each set of which are incrementally larger, are utilized. For example, the phase shift introduced by delay 1120*a* is, depending on the adjustment of the tap, some function of $$\Delta\phi_2\left(\text{i.e., } f\left(\frac{\Delta\phi_2}{2}+\frac{\Delta\phi_2}{2}\right)\right).$$

Likewise, the phase shift of a delay associated with another sub-group of antenna column a is some proportionally larger function of $$2\Delta\phi_2\left(\text{i.e., } f\left(\frac{2\Delta\phi_2}{2}+\frac{2\Delta\phi_2}{2}\right)\right).$$

Of course, as discussed above, any relationship of delays between the delay devices may be used that is determined to be advantageous.

Shown in FIG. 10 is delay controller 1000 coupled to each of the delay devices. Delay controller 1000 provides automated control of selection of the various delays to select a particular down-tilt. Selection of the delays may be a function of communication information, such as signal to noise or carrier to noise information, or selection may be a function of information provided by a communication network controller controlling a network of such antenna systems. Of course, selection of the various delays of delays 1020*a*–1020*d* may be by manual means, such as by physically rotating a switch associated with each delay device, if desired.

Likewise, shown in FIG. 11 is delay controller 1100. This may be an automated delay controller such as a servo-motor coupled to a common shaft gang or individual servo-motors coupled to each delay device. Automated adjustment may be based on communication parameters, communication network conditions, or the like. Controller 1100 may also be a manual adjustment means such as a mechanical dial coupled to a common shaft gang.

In a preferred embodiment, the above described controllers utilize control circuitry such as may be illustrated in FIG. 13. Preferably, automated control of the adjustment of the delays is accomplished by providing a communication parameter signal, such as is discriminated from a received signal by receiver 1340 in combination with CDMA code or supervisory audio tone/receive signal strength indicator (code/SAT/RSSI) demodulator 1350, to a control circuitry, such as is provided by error signal processor 1360, delay selection circuitry 1361, reference signal generator 1362, and signal combiner 1363. It shall be appreciated that a receiver and code/SAT/RSSI demodulator, such as receiver 1340 and code/SAT/RSSI demodulator 1350, are typically utilized with cellular telephone BTSes and, therefore, may be utilized without the addition of such circuitry.

Automated control of selection of delays associated with the phase-centers is provided when delay selection circuitry 1361 provides a control signal to the adjustable delays under control of error signal processor 1360. Error signal processor 1360 is a processor-based system including a processing unit (CPU) and memory (RAM). Within the RAM of processor 1360 is an algorithm executable on the CPU to provide delay selection control in response to supplied communication parameters.

Preferably, communication parameters provided to processor 1360 are those demodulated by code/SAT/RSSI demodulator 1350. In order to provide communication parameters necessary for the proper operation of delay selection circuitry 1361, preferably the output signal of code/SAT/RSSI demodulator 1350 is combined with a signal from reference signal generator 1362 by combiner 1363.

It shall be appreciated that reference signal generator 1362 may be adapted to provide a signal such that when it is combined with the output of code/SAT/RSSI demodulator 1350, that code/SAT/RSSI signals associated with a coupled antenna beam are eliminated, leaving only "foreign" code/SAT/RSSI signals to be communicated to processor 1360. Of course, any number of methods suitable to provide processor 1360 with communication parameters indicating the need to adjust the antenna system may be utilized, if desired.

A block diagram of a preferred embodiment of the steps performed by the algorithm of processor 1360 is illustrated in FIG. 14. At step 1401, processor 1360 determines if the foreign code/SAT/RSSI signal level is above acceptable limits, indicating undesirable overlap between the an antenna beam of this antenna array with that of a neighboring antenna array. If so, the antenna electrical down-tilt angle of this antenna beam is increased by selection of a proper phase differential at step 1402. Thereafter, processor 1360 again determines if the signal level is beyond acceptable limits. When the presence of an excessively high foreign code/SAT/RSSI signal is not detected, processor 1360 proceeds to step 1403.

At step 1403, processor 1360 determines if the foreign code/SAT/RSSI signal level is below allowable limits, indicating very little, or possibly no, overlap between the radiation pattern of this antenna beam with that of a neighboring antenna array. If so, the antenna electrical down-tilt is decreased at step 1404. Thereafter, processor 1360 again determines if the signal level is below allowable limits. When the presence of an excessively low foreign code/SAT/RSSI signal is not detected, processor 1360 proceeds to repeat the algorithm.

Of course, although the use of CDMA codes, SAT and RSSI signals has been discussed above, any communication parameters suitable to indicate the need for adjusting the electrical down-tilt of the antenna beams of the present invention may be used, if desired. For example, C to I ratio, energy density, or the like may be utilized by processor 1360 in the determination to adjust the electrical down-tilt of the antenna beams. Moreover, control signals from other antenna arrays, such as might be associated with neighboring BTSes in a cellular system, may be utilized by processor 1360 in its determination of adjusting the electrical down-tilt of the antenna beams. For example, where a neighboring BTS is experiencing undesirable interference and has adjusted tilt of its associated antenna modules to produce a minimum radiation pattern, or such tilting is not available, this neighboring BTS may provide a control signal to processor 1360 to result in its adjusting of the tilt to improve communication at the neighboring BTS.

Moreover, control of the antenna systems of the present invention may be accomplished centrally in order to provide optimum coverage with a minimum of inter BTS interference. Here, for example, a signal may be provided to processor 1360 by a central intelligence to result in system wide signal improvement. Alternatively, the function of processor 1360 may be wholly located at this central site, resulting in no autonomous control of the tilt by the individual BTS.

It shall be appreciated that, although the control system of FIG. 13 has been discussed with reference to selecting an electrical down-tilt angle, the circuits may be adapted to control a mechanical down-tilt angle. The above referenced application entitled "MULTI-SECTOR PIVOTAL ANTENNA SYSTEM AND METHOD" discloses control circuitry adapted to adjust a mechanical down-tilt angle suitable for use with the present invention.

As discussed above, the least amount of degradation of the scanned beam will be experienced where a phase-center is associated with a single row of antenna elements. However, as can be seen through reference to FIG. 7 and the above discussion of the additional circuitry required in the preferred embodiment in order to provide the desired phase differential to additional phase-centers, it becomes apparent that such a system has the disadvantage of more complicated and costly signal feed network. Specifically, in order to provide single antenna element row phase-centers to the antenna array of FIG. 7, two additional beam forming feed matrixes, along with their attendant phase shifters, would be required to provide individual phase progression to each of the rows of antenna elements. Accordingly, deployment of any particular embodiment the present invention will preferably include consideration as to the amount of beam shaping degradation that can be tolerated balanced against the complexity and expense of the signal feed network required for providing the phase-centers.

Figure 9A:
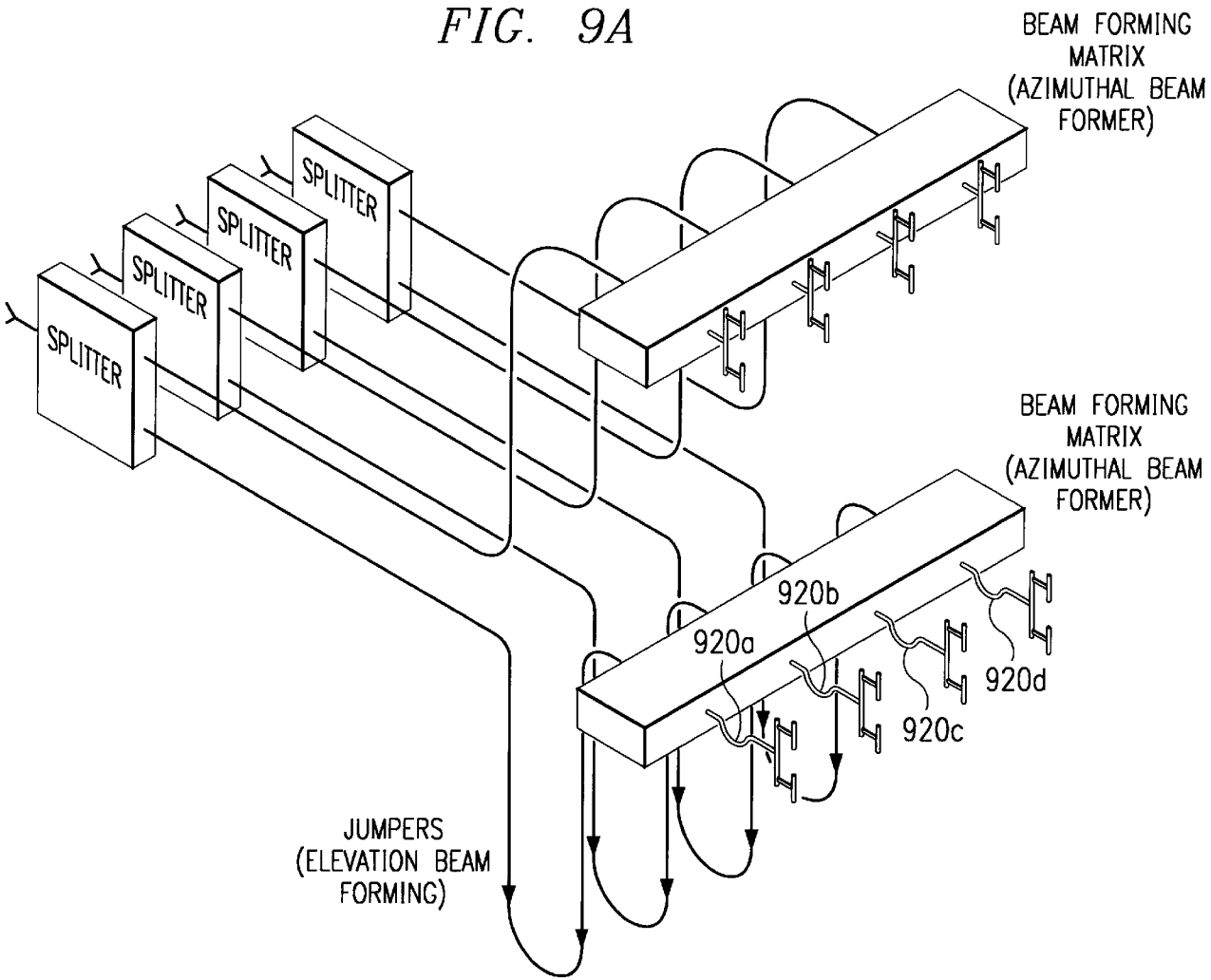
FIG. 9A illustrates the provision of a pre-tilt phase delay for a sub-group of antenna columns of the present invention.
Figure 9:
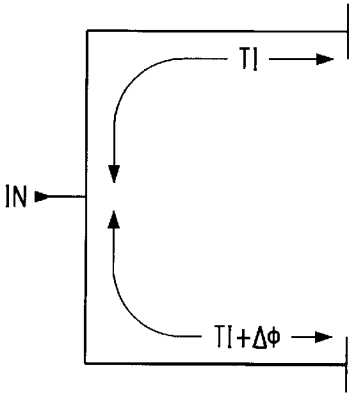
FIG. 9 illustrates the provision of a phase delay in a sub-group of antenna elements associated with a phase-center of the present invention.

It shall be appreciated that a predetermined amount of phase difference may be included between the elements of each column subsection to improve beam quality when steered down. For example, a phase difference between the individual elements of each column sub-group may be selected to optimize the beam at a predetermined down tilt angle. Referring to FIG. 9, a phase difference between the two elements of a column sub-group, such as those illustrated in FIG. 7, is shown as signal paths T1 and T1+$\Delta\phi$. This phase difference may be utilized to improve the composite beam quality when the signal of the antenna column is steered down.

For example, the delay associated with $\Delta\phi$, may be selected to optimize the beam at a predetermined down-tilt angle. Where a particular down-tilt angle is expected to predominate, $\Delta\phi$ may be selected to cause the summed signal of the elements of the column sub-group to result in that particular down-tilt. Of course, this intra sub-group down-tilt may introduce some undesirable characteristics when the composite beam of the antenna column sub-groups are summed. These undesirable characteristics would increase as the beam is steered further away from the down-tilt angle selected for the intra sub-group delay. Therefore, alternatively, $\Delta\phi$ may be selected to be commensurate with some angle between the various down-tilt angles expected to be used. This selection of $\Delta\phi$ would minimize the effect of the grating lobe generation at each of the down-tilt angles.

Of course, the phase difference $\Delta\phi$ may be introduced by variable delay means, such as described above, if desired. However, an advantage of the use of antenna column subsections in the electrical down-tilt, rather than individual elements, is to reduce the various components necessary to affect the electrical down-tilt. Adding variable delay means between the various antenna elements of the column subsections would increase the number of components used in achieving electrical down-tilt. However, it shall be appreciated that less expensive variable means, such as the aforementioned jumpers, may be utilized at the antenna column subsections to more economically provide such electrical down-tilt adjustable to each antenna element.

Additionally, a predetermined amount of phase difference may be included between each column subsection, such as to provide "pre-tilt" of desired minimum even without the use of the jumpers and adjustable delays described above. For example, a phase difference between the lower column sub-group and the upper column sub-group of FIG. 7 may be introduced as shown in FIG. 9A. Here a phase difference associated with a desired pre-tilt is introduced between the column sub-groups as pre-tilt half loops 910*a*–910*d*. This phase difference may be utilized to provide a desired minimum amount of down tilt regardless of the delays associated with jumpers 720*a*–720*d*. The pre-tilt half loops of FIG. 9A may be used in conjunction with the inter-column sub-group delay of FIG. 9, if desired.

In the preferred embodiment described above, electrical down-tilt is accomplished through the introduction of phase differences in the signal paths of feed networks associated with sub-groups of antenna elements. However, it shall be appreciated that elevation beam steering may be accomplished by introducing the phase differentials between the various elements of the radiator columns in the signal path between the feed matrix and the antenna elements. It shall be appreciated that this embodiment may utilize a single feed matrix while still providing electrical down-tilt. However, it shall also be appreciated that, as multiple ones of the antenna columns are utilized in forming each antenna beam, per beam elevation steering is not accomplished in this configuration where a plurality of antenna beam signals are provided simultaneously. Of course, through the use of time division multiplexing, per beam elevation steering may be accomplished by adjusting the delays for a first beam during its associated time division and adjusting the delays for a second beam during its associated time division.

Figure 12:
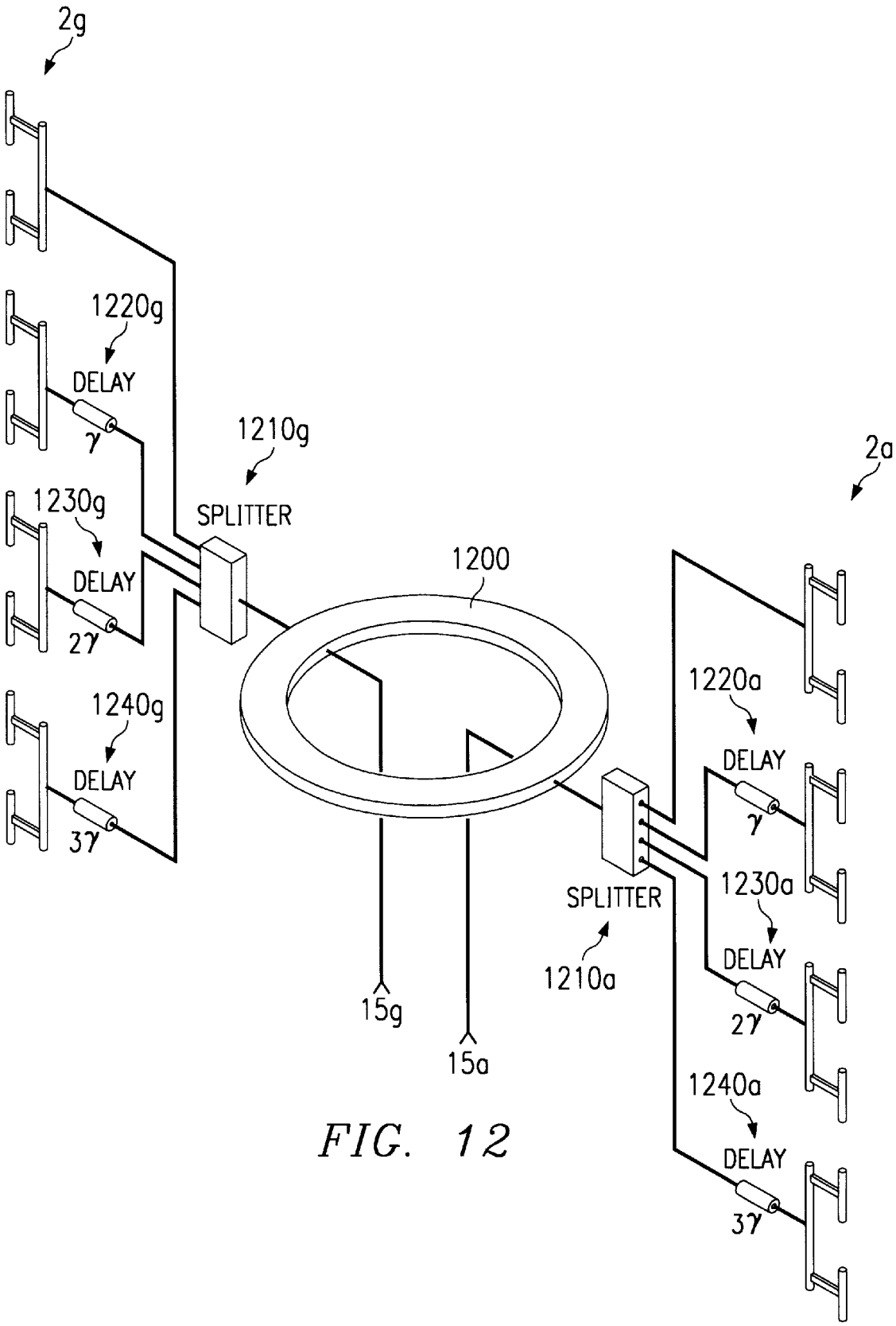
FIG. 12 illustrates an alternative embodiment of the present invention wherein phase delays are provided in the signal path between the beam forming feed network and the antenna elements of each sub-group.

FIG. 12 shows the introduction of phase differences between various elements of the radiator columns using a single feed matrix 1200. It shall be appreciated that, although only two radiation column inputs are illustrated for simplicity, the feed matrix may in fact feed any number of radiation columns.

FIG. 12 also illustrates the use a number of phase-centers, here four, greater than the two phase-centers of FIG. 7. Accordingly, the phase differential of each successive phase-center is proportionally increased to provide the above described elevation steering.

As described above, both the conical antenna system illustrated in FIG. 1 and the planar array illustrated in FIG. 4 utilize a ground plane. It shall be appreciated that these ground planes present a significant surface which, when disposed in an environment including winds, presents an appreciable wind load. As the aperture of the antenna is increased to provide increased gain, as described above, this wind load will also increase.

Accordingly, a preferred embodiment of the present invention provides for reduced wind load (reduced air drag) through the use of a "gridded" ground plane. The surface of the gridded ground plane is a screen having a surface adapted to provide desired reflection of signals radiated from the associated antenna elements while being substantially air permeable.

In order to provide the desired reflective ground plane surface, the passages in the gridded ground plane should not be greater than $\frac{1}{10}\lambda$ of the highest operating wavelength of the antenna structure. For example, an upper operating frequency of 896 MHz would have a free space wavelength of 12.18 inches. Thus, the largest dimension of the passages in the gridded ground plane could advantageously be approximately $1\frac{1}{3}$ inches. Where theses passages are square, the largest dimension is the diagonal across opposite corners of the square. Accordingly, the sides of square passages, utilized in a gridded ground plane of the present invention, where an upper operating frequency is 896 MHz, is approximately 0.93 inches. The thickness of the walls between the passages may be of any thickness suitable for providing structural integrity of the overall gridded ground plane.

Figure 19:
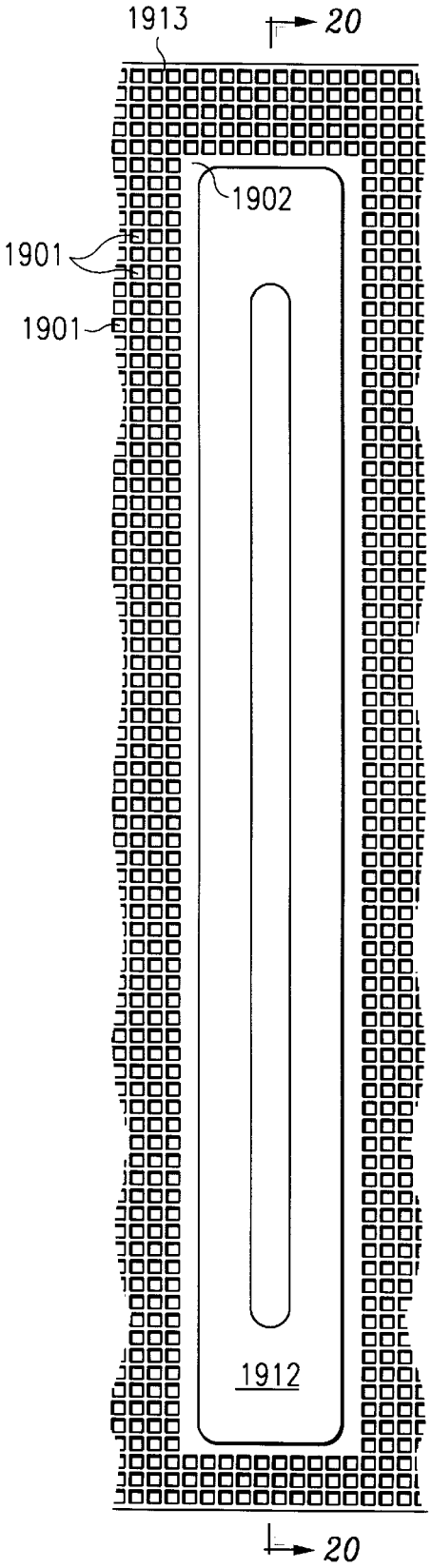
FIG. 19 illustrates a portion of a front elevation view of an antenna system having a gridded ground plane of the present invention.

Directing attention to FIG. 19, a portion of an antenna array, such as the aforementioned planar or cylindrical arrays, is shown utilizing the gridded ground plane of the present invention. Illustrated is gridded ground plane 1913 having square passages 1901 disposed therein. Radome 1912 incarcerates antenna element(s) such as those of any of the aforementioned antenna columns 2*a* through 2*l*.

Of course, although square passages are illustrated, any shape or shapes of passages deemed advantageous may be utilized. For example, triangles, hexagons, octagons, or circles may be used in place of, or in combination with, the square passages shown. However, it shall be appreciated that a passage shape or shapes allowing for their placement close to one another without substantial solid ground surface area disposed therebetween will provide the lowest wind load characteristics as more ground surface area may be comprised of the passages.

Also of concern is the above discussed largest dimension of the passages. A passage which provides a very large dimension in one direction as compared to the dimension of as measured in another direction, i.e., a large aspect ratio, will generally result in higher wind load characteristics. This is because an increased number of large aspect ratio passages will be required to cover the ground surface and, thus, an increased number and area of solid ground surface areas interconnecting the passages will be required.

Still referring to FIG. 19, the area of ground surface 1913 surrounding the antenna column is not gridded, i.e., includes no passages therethrough, and presents solid surface 1902. Solid surface 1902 is provided for weather sealing of the front and rear sides of the radome. Directing attention to FIG. 20, it can be more easily seen that radome 1912 presents a front portion and radome 1911 presents a back portion which attach to ground surface 1913 at solid surface 1902. Accordingly, radome 1911 and 1912 combine to present a weather tight container.

Of course, solid surface 1902 may be eliminated, such as to provide a fully gridded ground surface 1913 if desired. For example, where a radome is not desired, a fully gridded ground surface 1913 may be desired to present a minimum wind load. However, it shall be appreciated that radome 1911 and 1912 are shaped in the illustrated embodiment so as to provide an enhanced aerodynamic attribute. Of course, any radome shape, such as to further reduce the overall wind loading of the antenna structure may be utilized according to the present invention.

It shall be appreciated that solid surfaces, such as solid surface 1902 may be disposed at various positions on ground surface 1913 as deemed advantageous. For example, a solid surface may be disposed at a particular position on ground surface 1913 so as to provide added structural integrity, for example at a point where ground surface 1913 is coupled to another structure, such as a support structure. Of course, the number, size, and placement of such solid surfaces will affect the wind load experienced from the associated antenna array.

Figure 20:
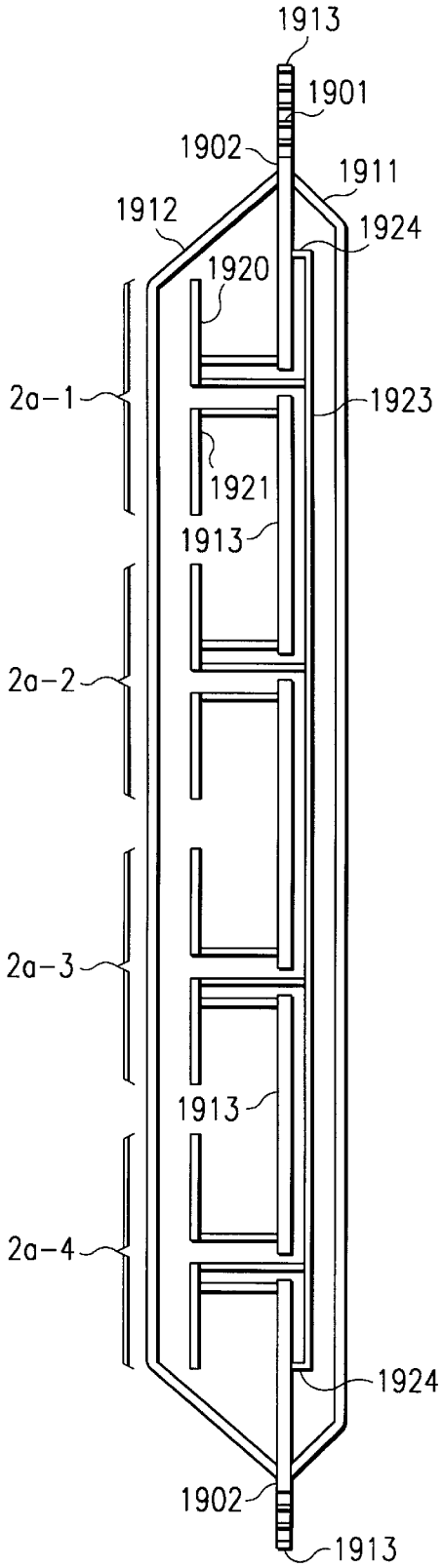
FIG. 20 illustrates a cross section view of the antenna portion of FIG. 19.

Still referring to FIG. 20, a preferred embodiment of the feed system coupling the antenna elements with the feed network of the present invention is shown. In the illustrated embodiment antenna column 2*a*, incarcerated by radomes 1911 and 1912, includes dipole antenna elements 2*a*-1, 2*a*-2, 2*a*-3, 2*a*-4 fed by air-line bus 1923. Of course, as discussed above the antenna column may be comprised of other forms of antenna elements and/or in differing numbers than those illustrated.

The dipole antenna elements include an upper and lower dipole half, dipole halves 1920 and 1921, one of which is coupled to the air-line bus through BALUN 1922. It shall be appreciated that the air-line bus, which is a single conductor suspended over the ground plane, is unbalanced and the BALUNs, coupling the dipole antennas thereto, operate to convert the structure from unbalanced to balanced.

Air-line bus 1923 is preferably coupled to an antenna feed network, such as those described above with respect to FIGS. 7 and 8. Accordingly, a plurality of antenna columns may be simultaneously excited by a signal as described above to destructively and beneficially combine in order to provide a desired radiation pattern. Of course, where electrical elevational antenna beam steering is desired, multiples of the antenna columns illustrated in FIG. 20 may be coupled to antenna feed systems as described above with respect to FIGS. 7, 8, and 12. Air-line bus 1923 also preferably includes quarter wave shorts 1924 disposed at the distal ends of the bus.

In a preferred embodiment, the air-line bus is coupled to the feed network at a mid point, such as between antenna elements 2*a*-2 and 2*a*-3. Such a connection aids in providing even power distribution amongst the antenna elements of the column. It shall be appreciated that a 180° phase shift is experienced in the excitation of the antenna elements disposed on the air-line above the air-line/feed network tap as compared to the antenna elements disposed on the air-line below the air-line/feed network tap. Accordingly, antenna elements 2*a*-1 and 2*a*-2 are provided with balun 1922 coupled to upper dipole half 1920 whereas antenna elements 2*a*-3 and *a*-4 are provided with balun 1922 coupled to lower dipole half 1921.

It shall be appreciated that the air-line bus utilized in the illustrated embodiment provides a profile substantially the same as the antenna elements comprising the antenna column. Accordingly, the wind load of the antenna system including the air-line bus feed system is substantially the same as the antenna system with the antenna elements and ground plane alone.

In an air-line bus most of the energy is confined in the space between the air-line bus and the ground plane. Accordingly, by placing a dielectric in this space the transmission properties of the antenna column may be substantially altered.

Figure 21:
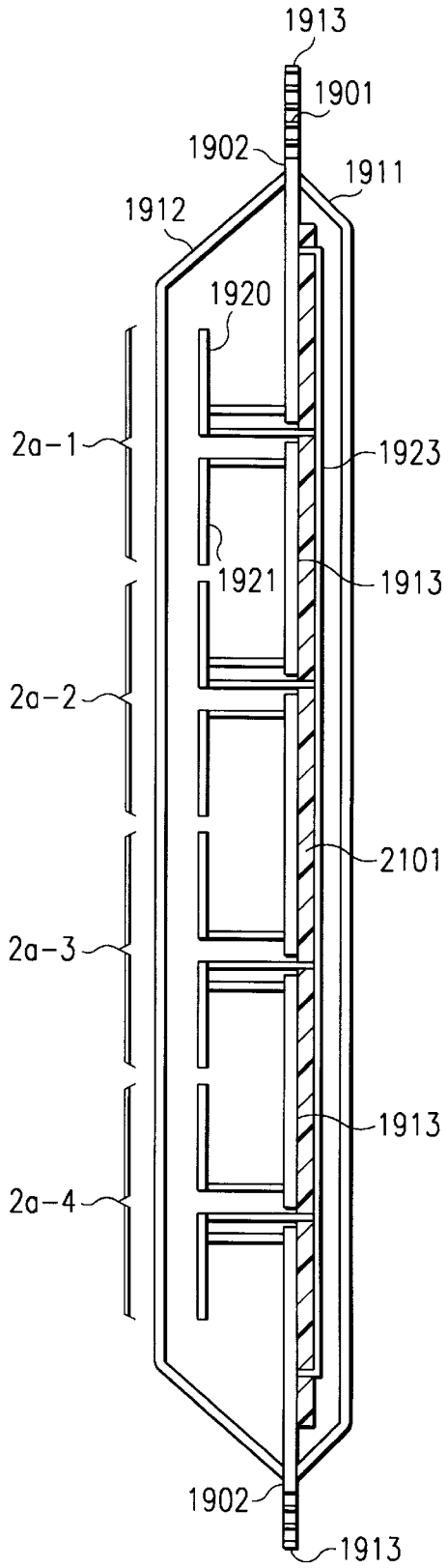
FIG. 21 illustrates a cross section view of an antenna portion wherein a dielectric load has been added to the air-line bus according to the present invention.

Experimentation has revealed that by placing a dielectric between the air-line bus and the ground plane of the present invention, as illustrated as dielectric load 2101 in FIG. 21, the propagation velocity of the electromagnetic energy being distributed along the column is retarded. This retardation of the propagation velocity, and the subsequent compression of the wave length, allows the spacing of the dipoles to be reduced. This reduction in inter-element spacing is done without substantially affecting the grating lobes.

Figure 22:
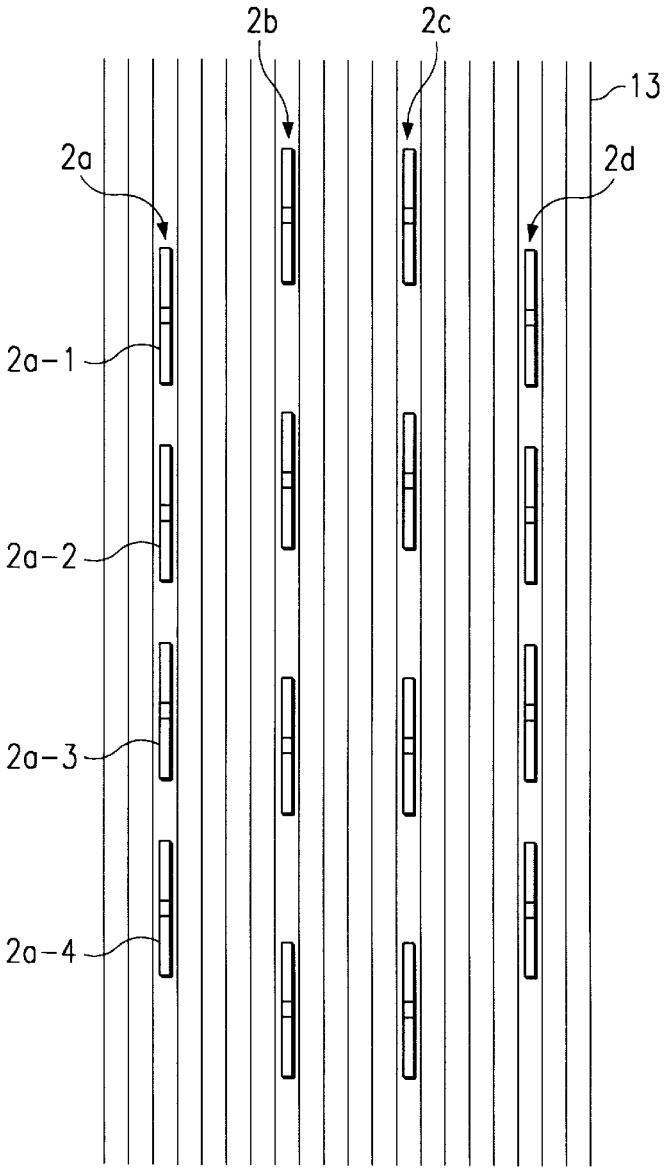
FIG. 22 illustrates a front elevation view of a planar array having compressed outer columns according to the present invention.

By placing reduced in length antenna columns, such as those having the dielectric line bus shown in FIG. 21 and a reduced inter-element spacing, on the outer edges of a phased array, aperture tapering for side lobe level control is accomplished. Directing attention to FIG. 22, a phased array having outer antenna columns 2*a* and 2*d* reduced in length to provide aperture tapering is shown.

Of course, antenna columns including the dielectric line bus of the present invention may be disposed wherever deemed advantageous in an antenna system. For example, in an array utilizing a large number of antenna columns, the columns next adjacent to the outer columns of antenna elements may utilize the dielectric line bus to reduce the length of these columns as well. Accordingly, by utilizing materials of differing dielectric properties on ones of the antenna columns, the aperture may be gradually tapered.

It shall be appreciated that by utilizing the dielectric line bus of the present invention, it is possible to taper the aperture of the array without adjusting the number of antenna elements provided in any of the antenna columns. Accordingly, balancing power among the antenna columns of the array is greatly simplified as providing a signal of equal power to each antenna column does not result in energization of the columns in an aperture distribution approaching an inverse cosine distribution as in the prior art.

Additionally, the dielectric line bus of the present invention may be utilized at each of the antenna columns in order to present an antenna array having an overall reduced size in order to provide a desired attribute such as reduced wind loading or aesthetic appeal. Accordingly, it is possible to provide an antenna array according to the present invention utilizing a desired number of antenna elements per column, such as for power balancing purposes either among the columns or among the antenna elements of the columns, without substantially altering the effective inter-element spacing, such as is a concern with the above mentioned grating lobes.

Amplitude tapering for side lobe level control may be achieved by loading the dielectric material with a lossy composite, such as carbon particles. These particles could be suspended throughout the dielectric material with a particular density selected to achieve the amount of side lobe control desired. It shall be appreciated that, by using dielectric material with a lossy composite according to the present invention with the outer columns of an antenna array, providing a signal of equal power to each antenna column results in energization of the columns in an aperture distribution approaching an cosine distribution or cosine to a power distribution.

Moreover, by distributing the lossy composite in the dielectric material of an antenna column to provide zones of differing levels of loss, i.e., low loss zones, medium loss zones, etc., side lobe levels may be further reduced. Directing attention to FIG. 23, the dielectric material of antenna column 2*a* includes zones of differing densities of lossy composite. In the illustrated embodiment zones 2301, disposed at the distal ends of the antenna column, are medium loss dielectric material and zone 2302 is low loss dielectric material with transition regions 2304 therebetween. Accordingly, providing a signal of equal power to each antenna column of an array, as described above, not only provides energization of the columns in an aperture distribution approaching a cosine distribution, but particular ones of the columns, such as the outer columns, may each energize their associated antenna elements in an aperture distribution approaching a cosine distribution or a cosine to a power distribution, i.e., $\cos^n(\chi)$, where n (exponent value) is not necessarily an integer.

Figure 23:
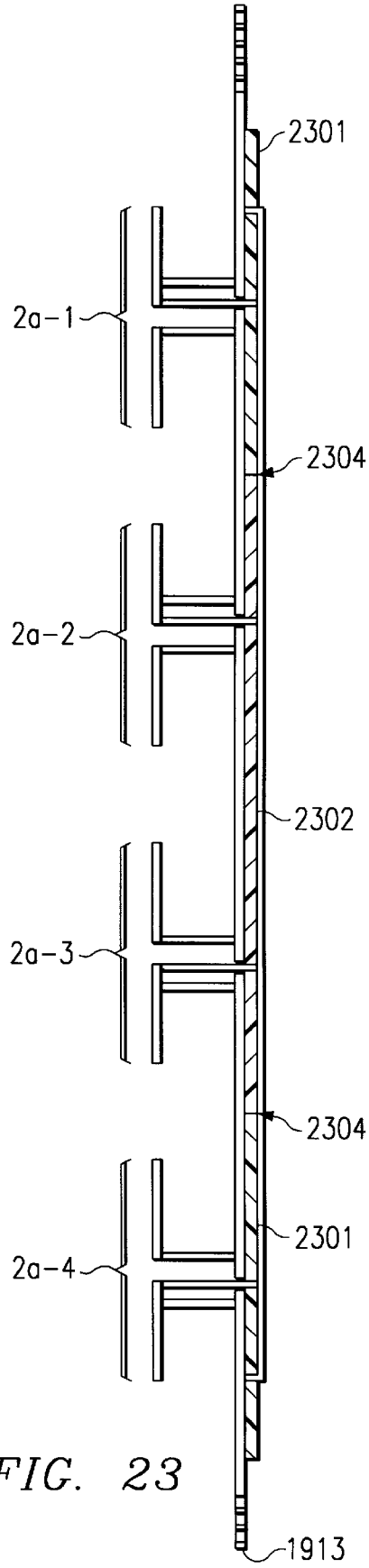
FIG. 23 illustrates zoned dielectric material in the dielectric line bus according to the present invention.

It shall be appreciated that where electrical down tilt is to be utilized, such as in the per beam steering discussed above, the distribution of the lossy composite in the dielectric material of an antenna columns may be different than that illustrated in FIG. 23. For example, where antenna column subsections having two antenna elements, such as illustrated in FIG. 7, are used, the antenna column of FIG. 23 may be separated between antenna elements 2*a*-2 and 2*a*-3. Accordingly, a first subsection having antenna elements 2*a*-1 and 2*a*-2 with medium loss dielectric material disposed behind antenna element 2*a*-1 and low loss dielectric material disposed behind antenna element 2*a*-2 may be utilized as an upper antenna subsection. Likewise, a second subsection having antenna elements 2*a*-3 and 2*a*-4 with low loss dielectric material disposed behind antenna element 2*a*-3 and medium loss dielectric material disposed behind antenna element 2*a*-4 may be utilized as a lower antenna subsection.

It shall be appreciated that the distribution of lossy composite in the dielectric material of the dielectric line bus of the present invention is not limited to that illustrated in FIG. 23 and may, in fact, be distributed in any pattern deemed advantageous. For example, the transition regions may be graded to provide a gradual transition rather than the abrupt transition illustrated. Likewise, the distribution of the lossy composite within the entire length of the dielectric material, or particular zones therein, may be graded, if desired.

Additionally, there is no limitation to the number of dielectric zones utilized according to the present invention. For example, where a larger number of antenna elements make up a column, it may be desirable to provide additional dielectric zones in order to more closely approach a cosine aperture distribution of energy for the column.

Although the present invention and its advantages have been described in detail, it should be understood that various changes, substitutions and alterations can be made herein without departing from the spirit and scope of the invention as defined by the appended claims. For example, although the present invention has been discussed herein with reference to antenna arrays having columns of antenna elements energized in sub-groups so as to provide a relative phase difference there between, it shall be appreciated that the present invention is operable with any number of antenna array configurations. Operation of the electrical down-tilt of the present invention requires only that a phase differential be present in a signal as appears at two antenna elements having at least some vertical separation.

Additionally, although the above discussion has been primarily directed to the transmit signal path, it shall be appreciated that the present invention operates equally well in the receive signal path. The methods and systems described herein will utilize the delays or phase shifts in the receive signal path in order define a receive antenna beam having a desired angle of down-tilt. Likewise, the gridded ground plane, air-bus and dielectric bus feed systems described herein are also useful in the receive signal path.

Furthermore, although the elevation scanning of the present invention has been described herein with respect to "down-tilt", it shall be appreciated that the antenna beams may in fact be steered both up and down. For example, antenna beams may be "up-tilted" in order to serve wireless communications at an elevation greater than that of the array, such as persons communicating in high rise towers, to enhance building penetration, or in air borne applications.

What is claimed is:

1. A system for providing adjustable elevation scanning per antenna beam of a multibeam phased array, wherein said phased array includes a plurality of antenna elements divisible as an upper sub-group and a lower sub-group, said system comprising:

first means for coupling a first signal path to said upper sub-group of antenna elements and to said lower sub-group of antenna elements, wherein said first coupling means provides a first phase differential between signals associated with said upper and lower sub-groups of antenna elements, and wherein said first signal path is associated with a first antenna beam of said multibeam phased array; and second means for coupling a second signal path to said upper sub-group of antenna elements and to said lower sub-group of antenna elements, wherein said second coupling means provides a second phase differential between signals associated with said upper and lower sub-groups of antenna elements, and wherein said second signal path is associated with a second antenna beam of said multibeam phased array.

2. The system of claim 1, wherein said first coupling means comprises:

a first beam forming signal feed matrix associated with said upper sub-group of antenna elements; and a second beam forming signal feed matrix associated with said lower sub-group of antenna elements.

3. The system of claim 2, wherein at least one of said first and second beam forming signal feed matrixes is removed from the locality of said multibeam phased array.

4. The system of claim 2, wherein said multibeam phased array includes a plurality of interlocking antenna columns each including an upper portion and a lower portion associated with said upper sub-group and said lower sub-group respectively, wherein said interlocking of said antenna columns is at least in part defined by coupling of ones of said antenna columns to said first signal path by said first and second beam forming signal feed matrixes.

5. The system of claim 2, wherein said first coupling means further comprises:

a splitter/combiner coupling said first signal path to said first and second beam forming signal feed matrixes.

6. The system of claim 2, wherein said first phase differential is provided by a means for introducing a delay in a signal path associated with said second beam forming signal feed matrix coupled to said first signal path.

7. The system of claim 6, wherein said delay means comprises a removable predetermined length of transmission cable adapted to provide a predetermined angle of elevation scanning.

8. The system of claim 7, wherein said predetermined length of transmission cable is selected from a plurality of predetermined lengths of transmission cable each of which are adapted to provide a different predetermined angle of elevation scanning.

9. The system of claim 6, wherein said delay means comprises an in-phase and quadrature signal combiner adapted to provide a predetermined angle of elevation scanning.

10. The system of claim 6 wherein said delay means comprises an adjustable delay device providing a plurality of selectable angles of elevation scanning.

11. The system of claim 10, wherein said adjustable delay device includes a plurality of switchably selectable lengths of transmission cable.

12. The system of claim 10, wherein said adjustable delay device includes a continuously adjustable length signal path.

13. The system of claim 10, further comprising:

means for automatically adjusting said adjustable delay device.

14. The system of claim 1, wherein said plurality of antenna elements of said phased array is also divisible as an intermediate sub-group of antenna elements, and wherein said first coupling means also couples said first signal path to said intermediate sub-group of antenna elements, said first coupling means providing a third phase differential between signals associated with said upper and intermediate sub-groups of antenna elements.

15. The system of claim 14, wherein said first phase differential has a predetermined proportional relationship to said third phase differential.

16. The system of claim 1, wherein said upper sub-group of antenna elements includes at least two rows of antenna elements at least one of which is disposed vertically higher than another row.

17. The system of claim 16, wherein said lower sub-group of antenna elements includes at least two rows of antenna elements at least one of which is disposed vertically higher than another row.

18. The system of claim 16, wherein a phase differential is provided between elements of said at least two rows of antenna elements.

19. The system of claim 1, further comprising:

means for retarding the propagation velocity of electromagnetic energy distributed by said first coupling means to ones of said upper sub-group and lower sub-group of antenna elements.

20. The system of claim 19, wherein the antenna elements of the sub-groups of antenna elements coupled to the retarding means are more closely spaced to a next adjacent antenna element than are the antenna elements of the remaining sub-groups of antenna elements.

21. The system of claim 19, wherein said retarding means comprises:

means for attenuating the amplitude of radiated energy associated with the sub-groups of antenna elements coupled to the retarding means with respect to the amplitude of radiated energy associated with the remaining sub-groups of antenna elements.

22. The system of claim 19, wherein said retarding means comprises:

means for attenuating the amplitude of radiated energy associated with ones of the antenna elements of the sub-groups of antenna elements coupled to the retarding means with respect to the amplitude of radiated energy associated with other ones of the antenna elements of the sub-groups of antenna elements coupled to said retarding means.

23. The system of claim 19, wherein said retarding means comprises:

a plurality of antenna column feed buses ones of which are coupled to antenna elements of said upper sub-group of antenna elements and other ones of which are coupled to antenna elements of said lower sub-group of antenna elements, wherein ones of said feed buses have a dielectric material disposed between the feed bus and said coupled one of said sub-group of antenna elements and other ones of said feed buses have an air space disposed between the feed bus and said coupled one of said sub-group of antenna elements.

24. The system of claim 23, wherein at least one of said dielectric buses includes a dielectric material having a dielectric constant greater than that of another of said dielectric buses.

25. The system of claim 23, wherein at least one of the dielectric buses is adapted to provide amplitude attenuation.

26. The system of claim 25, wherein said at least one dielectric bus includes a lossy composite in a portion of said dielectric material.

27. The system of claim 26, wherein said lossy composite is distributed in different densities in said portion of said dielectric material.

28. A method for providing independent adjustable elevation scanning for antenna beams of a multibeam array, wherein said array includes a plurality of antenna elements divisible as a first sub-group and a second sub-group, said method comprising the steps of:

coupling a first signal path to said first and second sub-groups of antenna elements, wherein said first signal path is associated with a first antenna beam of said array;

introducing a first phase differential between signals associated with said first and second sub-groups of antenna elements;

coupling a second signal path to said first and second sub-groups of antenna elements, wherein said second signal path is associated with a second antenna beam of said array: and introducing a second phase differential between signals associated with said first and second sub-groups of antenna elements.

29. The method of claim 28, wherein said first phase differential is introduced only with respect to a signal associated with said first signal path.

30. The method of claim 28, wherein said step of introducing a first phase differential includes the step of:

selecting a predetermined delay in a signal path associated with said second sub-group of antenna elements.

31. The method of claim 28, wherein said step of coupling a first signal path comprises the steps of:

coupling a first beam forming signal feed network between said first signal path and said first sub-group of antenna elements; and coupling a second beam forming signal feed network between said first signal path and said second sub-group of antenna elements.

32. The method of claim 31, wherein said step of coupling a first signal path further comprises the step of:

coupling a signal splitter/combiner to said first signal path and each of said first and second beam forming signal feed networks.

33. The method of claim 31, wherein said first phase differential is introduced by a delay in a signal path associated with said second beam forming signal feed network.

34. The method of claim 32, wherein said delay comprises a removable predetermined length of transmission cable.

35. The method of claim 33, wherein said delay comprises an adjustable delay device.

36. The method of claim 35, further comprising the step of:

automatically adjusting said adjustable delay device.

37. The method of claim 28, further comprising the step of:

retarding the propagation velocity of electromagnetic energy distributed by said first signal path to ones of said first and second sub-groups of antenna elements.

38. The method of claim 37 further comprising the step of:

spacing the antenna elements of the sub-groups of antenna elements to which the propagation velocity of electromagnetic energy is retarded more closely to a next adjacent antenna element than the antenna elements of the remaining sub-groups of antenna elements.

39. The method of claim 37 wherein said retarding step comprises:

attenuating the amplitude of radiated energy associated with the sub-groups of antenna elements to which the propagation velocity of electromagnetic energy is retarded.

40. The method of claim 37, wherein said retarding step comprises:

attenuating the amplitude of radiated energy associated with ones of the antenna elements of the sub-groups of antenna elements to which the propagation velocity of electromagnetic energy is retarded with respect to the amplitude of radiated energy associated with other ones of the antenna elements of the sub-groups of antenna elements to which the propagation velocity of electromagnetic energy is retarded.

41. A system for providing adjustable elevation scanning in a multibeam antenna system having a plurality of radiating structures, wherein at least two of said radiating structures are displaced vertically with respect to each other, said system comprising:

means for forming a first antenna beam of said multibeam antenna system by associating an input signal with a preselected group of said radiating structures, said group of radiating structures selected such that excitation by said input signal combines to form a predetermined azimuthal beam width thereby defining said first antenna beam; and means for electrically tilting said first antenna beam by associating a phase differential with a first sub-group of said preselected group of radiating structures relative to a second sub-group of said preselected group of radiating structures, wherein said first sub-group of radiating structures includes a first one of said at least two vertically displaced radiating structures and said second sub-group of said radiating structures includes a second one of said at least two vertically displaced radiating structures, and wherein said relative phase differential provided by said providing means is associated only with said first antenna beam thereby independently adjusting said first antenna beam with respect to other antenna beams of said antenna system.

42. The system of claim 41, wherein said tilting means comprises:

means for retarding a phase of said input signal as associated with said first sub-group of radiating structures, wherein said phase differential includes said retarded phase of said retarding means.

43. The system of claim 42, wherein said retarding means comprises:

a removable jumper disposed in a signal path associated with said first sub-group of radiating structures.

44. The system of claim 42, wherein said retarding means comprises:

an adjustable delay device disposed in a signal path associated with said first sub-group of radiating structures.

45. The system of claim 44 further comprising:

means for controlling said adjustable delay device.

46. The system of claim 41, wherein said forming means comprises:

a plurality of beam forming networks, a first beam forming network of said plurality being associated with said first sub-group of radiating structures and a second beam forming network of said plurality being associated with said second sub-group of radiating structures.

47. The system of claim 41, further comprising:

means for reflecting energy radiated from said plurality of radiating structures in a selected direction.

48. The system of claim 47, wherein said reflecting means comprises:

means for providing air permeability.

49. The system of claim 48, wherein said permeability means includes passages having a largest dimension of approximately $1/10\ \lambda$ of the highest operating wavelength of said system.

50. An antenna system providing a plurality of antenna beams adapted to provide independently selectable down-tilt for ones of said plurality of antenna beams, said system comprising:

an array of antenna elements, wherein said array includes a plurality of antenna element columns, ones of said columns including a plurality of antenna elements;

a first beam forming matrix coupled to antenna elements of said array;

a second beam forming matrix coupled to antenna elements of said array, wherein said first and second beam forming matrixes are each coupled to different antenna elements of said columns including a plurality of antenna elements; and a first phase adjusting circuit coupled to said second beam forming matrix, wherein said phase adjusting circuit alters a phase of a first signal associated with said second beam forming matrix a predetermined amount with respect to a first signal associated with said first beam forming matrix thereby providing elevation scanning of a first antenna beam of said plurality of antenna beams.

51. The system of claim 50, further comprising:

a second phase adjusting circuit coupled to said second beam forming matrix, wherein said first phase adjusting circuit and said second phase adjusting circuit both alter a phase of said first signal.

52. The system of claim 50, wherein said first phase adjusting circuit comprises:

a removable predetermined length of cable disposed in a signal path of said second beam forming matrix.

53. The system of claim 50, wherein said first phase adjusting circuit comprises:

an adjustable delay disposed in a signal path of said second beam forming matrix.

54. The system of claim 50, further comprising:

a second phase adjusting circuit coupled to said second beam forming matrix, wherein said phase adjusting circuit alters a phase of a second signal associated with said second beam forming matrix a predetermined amount with respect to a second signal associated with said first beam forming matrix thereby providing elevation scanning of a second antenna beam of said plurality of antenna beams.

55. The system of claim 50, wherein said antenna system is a planar array.

56. The system of claim 50, wherein said antenna system is a conical array.

57. The system of claim 50, wherein said antenna system is adapted to provide mechanical down-tilt to which said independently selectable down-tilt is added.

58. An antenna array providing aperture tapering for side lobe level control, said antenna comprising:

a plurality of antenna element columns each of which includes a same number of antenna elements; and a plurality of antenna column feed buses each associated with an antenna element column of said plurality, wherein said feed buses are disposed substantially parallel to and proximal to said associated one of said antenna element columns, wherein ones of said feed buses have a dielectric material disposed between the feed bus and said associated one of said antenna element columns thereby defining dielectric line buses and other ones of said feed buses have an air space disposed between the feed bus and said associated one of said antenna element columns thereby defining air line buses, and wherein the antenna elements of the antenna element columns associated with said dielectric line buses have an inter column element spacing less than that of the antenna elements of the antenna element columns associated with said air line buses.

59. The antenna of claim 58, wherein said plurality of antenna element columns are disposed in a planar array of parallel antenna element columns, and wherein said antenna element columns associated with said dielectric line buses are disposed at the outer edges of said planar array.

60. The antenna of claim 59, wherein ones of said dielectric line buses include different densities of dielectric material, and wherein antenna element columns associated with dielectric line buses having a more dense dielectric material are disposed at the distal ends of said planar array and antenna element columns associate with dielectric line buses having a less dense dielectric material are disposed adjacent to said distal ends.

61. The antenna of claim 58, wherein at least a portion of said dielectric material is adapted to provide amplitude tapering.

62. The antenna of claim 61, wherein said portion of dielectric material includes a lossy material.

63. The antenna of claim 62, wherein said lossy material is carbon.

64. The antenna of claim 62, wherein said lossy material is distributed throughout said portion of dielectric material in zones of differing densities.

65. An antenna array providing aperture tapering for side lobe level control, said antenna comprising:

a ground plane;

a plurality of antenna element columns each of which includes a same number of antenna elements, wherein said plurality of antenna columns are disposed substantially parallel to and in close proximity to said ground plane;

a plurality of antenna column feed buses each associated with an antenna element column of said plurality, wherein said ground plane is disposed between said plurality of feed buses and an associated one of said antenna element columns, and wherein ones of said feed buses have a dielectric material disposed between the feed bus and the ground plane thereby defining dielectric line buses and other ones of said feed buses have an air space disposed between the feed bus and the ground plane thereby defining air line buses, and wherein the antenna elements of the antenna element columns associated with said dielectric line buses have an inter column element spacing less than that of the antenna elements of the antenna element columns associated with said air line buses; and a beam forming matrix coupled to said plurality of feed buses, wherein substantially a same power level signal is applied by said beam forming matrix to each of said plurality of antenna element columns when energized.

66. The array of claim 65, wherein said dielectric line buses are associated with outer antenna element columns of said plurality of antenna columns.

67. The array of claim 65, wherein at least one said dielectric line bus includes a lossy material.

68. The antenna array of claim 67, wherein said lossy material is distributed in zones of differing densities in said dielectric material.

69. The antenna array of claim 68, wherein said zones of differing densities of lossy material are selected to provide tapering of a composite signal radiated from an antenna element column associated with said at east one dielectric line bus.

70. The antenna array of claim 65, wherein said ground plane includes a plurality of passages disposed therein, wherein said passages define a gridded surface of said ground plane.

71. The antenna array of claim 70, wherein the largest dimension of said passages is selected to be approximately $1/10\ \lambda$ of the highest operating wavelength of said array.

72. A phased antenna array providing a plurality of antenna beams adapted to provide independently selectable down-tilt for ones of said plurality of antenna beams, said array comprising:

a ground plane having a plurality of passages disposed therein, wherein said passages define a gridded surface of said ground plane;

an array of antenna elements, wherein said array includes a plurality of antenna element columns, ones of said columns including a plurality of said antenna elements, and wherein said plurality of antenna columns are disposed substantially parallel to and in close proximity to said ground plane;

a plurality of antenna column feed buses each associated with an antenna element column of said plurality, wherein said ground plane is disposed between said plurality of feed buses and an associated one of said antenna element columns, and wherein ones of said feed buses have a dielectric material disposed between the feed bus and the ground plane;

a first beam forming matrix coupled to ones of the plurality of feed buses;

a second beam forming matrix coupled to other ones of the plurality of feed buses, wherein said first and second beam forming matrixes are each coupled to different antenna elements of said columns including a plurality of antenna elements; and a first phase adjusting circuit coupled to said second beam forming matrix, wherein said phase adjusting circuit alters a phase of a first signal associated with said second beam forming matrix a predetermined amount with respect to a first signal associated with said first beam forming matrix thereby providing elevation scanning of a first antenna beam of said plurality of antenna beams.

73. The antenna array of claim 72, wherein said ones of said feed buses having a dielectric material disposed between the feed bus and the ground plane are associated with outer antenna columns of said plurality of antenna columns of said array.

74. The antenna array of claim 72, wherein said dielectric material associated with at least one antenna column of said plurality of antenna columns includes a lossy material.

75. The antenna array of claim 74, wherein said at least one antenna column associated with said dielectric material including lossy material is selected to provide amplitude tapering.

76. The antenna array of claim 74, wherein said lossy material is distributed in zones of differing densities in said dielectric material.

77. The antenna array of claim 76, wherein said zones of differing densities of lossy material are selected to provide tapering of a composite signal radiated from said at least one antenna element column.

78. The antenna array of claim 72, wherein a largest dimension of said passages is selected to be approximately $\frac{1}{10}\lambda$ of the highest operating wavelength of said array.

* * * * *